US012061038B2

(12) United States Patent
Roh et al.

(10) Patent No.: US 12,061,038 B2
(45) Date of Patent: Aug. 13, 2024

(54) REFRIGERATOR

(71) Applicant: Samsung Electronics Co., Ltd., Suwon-si (KR)

(72) Inventors: Heeyuel Roh, Suwon-si (KR); Jeongmin Jeon, Suwon-si (KR); Yongsoo Kyong, Suwon-si (KR); Kookjeong Seo, Suwon-si (KR); Wonjae Yoon, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 320 days.

(21) Appl. No.: 17/560,970

(22) Filed: Dec. 23, 2021

(65) Prior Publication Data

US 2022/0205703 A1 Jun. 30, 2022

Related U.S. Application Data

(63) Continuation of application No. PCT/KR2021/017142, filed on Nov. 22, 2021.

(30) Foreign Application Priority Data

Dec. 29, 2020 (KR) ..... 10-2020-0186447

(51) Int. Cl.
*F25D 17/06* (2006.01)
*F25D 17/04* (2006.01)

(52) U.S. Cl.
CPC ..... *F25D 17/062* (2013.01); *F25D 17/045* (2013.01); *F25D 2317/0671* (2013.01)

(58) Field of Classification Search
CPC ..... F25D 17/045; F25D 17/065
See application file for complete search history.

(56) References Cited

U.S. PATENT DOCUMENTS

| | | | |
|---|---|---|---|
| 5,943,870 | A | 8/1999 | Lee |
| 2020/0033046 | A1 | 1/2020 | Song et al. |

FOREIGN PATENT DOCUMENTS

| | | | |
|---|---|---|---|
| JP | 6-1145 | B2 | 1/1994 |
| KR | 840001679 | Y1 * | 9/1984 |
| KR | 91-0008325 | | 10/1991 |
| KR | 10-0171526 | B1 | 5/1999 |
| KR | 20-0161920 | Y1 | 12/1999 |

(Continued)

OTHER PUBLICATIONS

International Search Report and Written Opinion of the Searching Authority dated Mar. 7, 2022 from International Application No. PCT/KR2021/017142.

*Primary Examiner* — Eric S Ruppert
(74) *Attorney, Agent, or Firm* — STAAS & HALSEY LLP

(57) ABSTRACT

A refrigerator includes a plurality of storage compartments and an evaporator configured to generate cold air through heat exchange. A duct includes a plurality of channels to carry cold air to the plurality of storage compartments and a fan is configured to supply cold air generated by the evaporator to the plurality of channels. A cold-air adjuster includes a plurality of open or close members provided in the plurality of channels, to adjust the volume of cold air flowing into the plurality of storage compartments. An actuator is configured to interlock operation of one of the plurality of open or close members with operation of another of the open or close members.

17 Claims, 38 Drawing Sheets

(56) References Cited

FOREIGN PATENT DOCUMENTS

| | | | |
|---|---|---|---|
| KR | 10-0366514 | | 1/2003 |
| KR | 10-0539597 | B1 | 12/2005 |
| KR | 10-0570534 | | 4/2006 |
| KR | 10-0593360 | | 6/2006 |
| KR | 10-2009-0043825 | | 5/2009 |
| KR | 10-2020-0013467 | A | 2/2020 |

* cited by examiner

REFRIGERATOR

CROSS-REFERENCE TO RELATED APPLICATIONS

This application is a continuation application under 35 U.S.C. § 111(a) of International Patent Application No. PCT/KR2021/017142, filed Nov. 22, 2021 which claims foreign priority benefit under 35 U.S.C. § 119 of Korean Patent Application No. 10-2020-0186447, filed on Dec. 29, 2020, in the Korean Intellectual Property Office, the contents of both of which are incorporated herein by reference.

BACKGROUND

1. Field

The disclosure relates to a refrigerator having a function of adjusting cold air for a plurality of storage compartments.

2. Description of Related Art

In a mono-cycle refrigerator using a single evaporator for cooling both an upper freezer compartment and a lower refrigerator compartment, cold air passed through the evaporator positioned behind the freezer compartment is circulated by a fan along a channel. A certain amount of cold air passed through the fan is distributed to the freezer compartment through a freezer compartment outlet provided in a duct placed in front of the evaporator, and the remaining amount of cold air is distributed to the refrigerator compartment and discharged through the refrigerator compartment outlet. Below the evaporator, cold air exhausted after cooling the freezer compartment and cold air exhausted after cooling the refrigerator compartment are mixed, and such mixed air is returned to the evaporator and subjected again to cooling and circulating.

When a user does not need to use the freezing temperatures of the freezer compartment but needs only to use the refrigerating temperatures of the refrigerator compartment, there is a need to convert the freezer compartment into a refrigerator compartment. To this end, the related art has proposed that an opening degree of a cold-air outlet of the freezer compartment be adjusted through a rotary damper to vary the amount of cold air.

However, such related art only provides the function of switching over to the freezing mode or the refrigerating mode without a function of entering an off mode. Besides, the related art has a complicated structure, thereby increasing manufacturing costs and causing a problem with durability.

Accordingly, an aspect of the disclosure is to provide a refrigerator which has a simple structure for controlling cold air in a plurality of storage compartments, is convenient to control, reduces manufacturing costs and is durable.

SUMMARY

In accordance with an aspect of the disclosure, there is provided a refrigerator comprising: a plurality of storage compartments; an evaporator configured to generate cold air; a duct comprising a plurality of channels to carry cold air to the plurality of storage compartments; and a cold-air adjuster comprising a plurality of open or close members provided in the plurality of channels to adjust a volume of cold air flowing into the plurality of storage compartments, and an actuator coupled to one of the open or close members which is coupled to another of the open or close members, the actuator being configured to operate the one of the open or close members which causes another of the open or close members to operate.

The plurality of storage compartments comprises a first storage compartment and a second storage compartment; the plurality of channels comprises a connection channel to carry cold air to the first storage compartment, and a cold-air outlet to discharge cold air to the second storage compartment; the one of the open or close members comprises a first open or close member to adjust the volume of cold air passing through the connection channel; and the another of the open or close members comprises a second open or close member to adjust the size of the cold-air outlet.

The actuator comprises a manipulator; the first and second open or close members comprise first and second shutters, and the manipulator comprises a knob extending from the first shutter and configured to be manipulated by a user; and a guide slot in the second shutter to accommodate the knob to guide movement of the knob.

The guide slot comprises: a horizontal slot to guide movement of the knob accommodated therein in a horizontal direction so that the first shutter can adjust the volume of cold air passing through the connection channel; and an inclined slot elongated in a vertically inclined direction communicating with the horizontal slot, and configured to move the second shutter vertically as the knob moves in a horizontal direction.

The second shutter switches over between a first mode and a second mode based on vertical movement, in which the first mode is configured to increase or decrease the size of the cold-air outlet and the second mode is configured to close or open the cold-air outlet.

The plurality of storage compartments comprises a first storage compartment and a second storage compartment, the plurality of channels comprises a connection channel to carry cold air to the first storage compartment, and a cold-air outlet to discharge cold air to the second storage compartment, the one of the open or close members comprises a first open or close member to adjust the volume of cold air flowing in the connection channel, and the another of the open or close members comprises a second open or close member to increase or decrease the volume of cold air discharged to the cold-air outlet, and a further open or close member comprises a third open or close member to close or open the cold-air outlet.

The actuator comprises a manipulator, the first, second or third open or close members comprise first, second or third shutters, respectively and the manipulator comprises, a knob extending from the first shutter and configured to be manipulated by a user; a first guide slot in the second shutter to guide movement of the knob accommodated therein; and a second guide slot in the third shutter to overlap with the first guide slot and guide movement of the knob accommodated therein.

The first guide slot comprises: a first horizontal slot to guide the movement of the knob accommodated therein in a horizontal direction so that the first shutter adjusts the volume of cold air passing through the connection channel; a first inclined slot elongated in a vertically inclined direction to communicate with the first horizontal slot, move the second shutter in a vertical direction to adjust the size of the cold-air outlet as the knob moves in the horizontal direction; and a second horizontal slot to communicate with the first inclined slot and to guide movement of the knob in the horizontal direction, and the second guide slot comprises: a third horizontal slot to guide movement of the knob accommodated therein in the horizontal direction so that the first shutter is configured to adjust the amount of cold air passing through the connection channel; a second inclined slot elongated in the vertically inclined direction to communicate with the third horizontal slot, and to cause the third shutter to move in the vertical direction to adjust the size of the cold-air outlet as the knob moves in the horizontal direction; and a third inclined slot elongated in the vertically inclined direction to communicate with the second inclined slot, and to cause the third shutter to move in the vertical direction to close or open the cold-air outlet as the knob moves in the horizontal direction.

The first guide slot comprises: a first horizontal slot to guide movement of the knob accommodated therein in a horizontal direction so that the first shutter is configured to adjust the volume of cold air passing through the connection channel; a first inclined slot elongated in a vertically inclined direction to communicate with the first horizontal slot, and to cause the second shutter to move in a vertical direction to adjust the size of the cold-air outlet as the knob moves in the horizontal direction; and a second horizontal slot communicating with the first inclined slot and to guide movement of the knob in the horizontal direction, and the second guide slot comprises: a third horizontal slot to guide movement of the knob accommodated therein in the horizontal direction to adjust the volume of cold air passing through the connection channel; and a second inclined slot elongated in the vertically inclined direction to communicate with the third horizontal slot, to cause the third shutter to move in the vertical direction to adjust the size of the cold-air outlet as the knob moves in the horizontal direction, and overlapping the same length with the first inclined slot.

The second shutter is configured to move vertically in the first inclined slot to adjust the size of the cold-air outlet as the knob horizontally moves, and the third shutter is configured to move horizontally in a lower end portion of the second inclined slot to close or open the cold-air outlet as the knob horizontally moves.

The manipulator comprises at least one of an X-link or a rack and a pinion or a crank to move the second shutter up or down based on manipulation of the first shutter.

In accordance with an aspect of the disclosure, there is provided a refrigerator comprising: a main body comprising a first storage compartment and a second storage compartment separate from the first storage compartment; a duct comprising a channel to carry cold air, a plurality of cold-air exits to discharge cold air to the first storage compartment, and a connection channel to carry cold air to the second storage compartment; and a cold-air adjuster comprising a plurality of open or close members to adjust the volume of cold air discharged to the first storage compartment and the second storage compartment, and an actuator configured to cause the plurality of open or close members to move, the actuator being configured to move between a first position to adjust the volume of cold air discharged to the first storage compartment and a second section for adjusting the amount of cold air discharged to the second storage compartment.

The plurality of open or close members comprises: first and second open or close members to adjust the volume of cold air supplied to the first storage compartment; and a third open or close member to adjust the volume of cold air supplied to the second storage compartment, wherein at least one of the plurality of open or close members is configured to move based on movement of the actuator.

The size the cold-air through hole of the third open or close member is varied based on the position of the actuator in the second position to adjust the volume of cold air passing through the connection channel.

A size of a cold-air outlet is varied based on the first or second open or close member being moved based on the first or second open or close member being moved based on a position of the actuator.

In accordance with another aspect of the disclosure, there is provided a refrigerator comprising: a main body having a refrigerator compartment and a freezer compartment; an evaporator configured to provide cold air; a first channel to carry the cold air to the refrigerator compartment and a second channel to carry the cold air to the freezer compartment; a cold air adjuster comprising a first damper configured to adjust a volume of cold air flowing into the refrigerator compartment, a second damper configured to adjust the volume of cold air flowing into the freezer compartment, and an actuator configured to operate the first and second dampers to cause the freezer compartment be supplied with cold air sufficient to produce freezing or refrigeration, or to stop the flow of cold air to the freezer compartment, based on a position of the actuator.

The actuator extends from the first damper to control operation of the first damper, and the first damper is coupled to the second damper such that the movement of the first damper causes movement of the second damper based on the position of the actuator.

BRIEF DESCRIPTION OF THE DRAWINGS

The above and other aspects, features, and advantages of certain embodiments of the present disclosure will be more apparent from the following description taken in conjunction with the accompanying drawings, in which.

DETAILED DESCRIPTION

Figure 1:
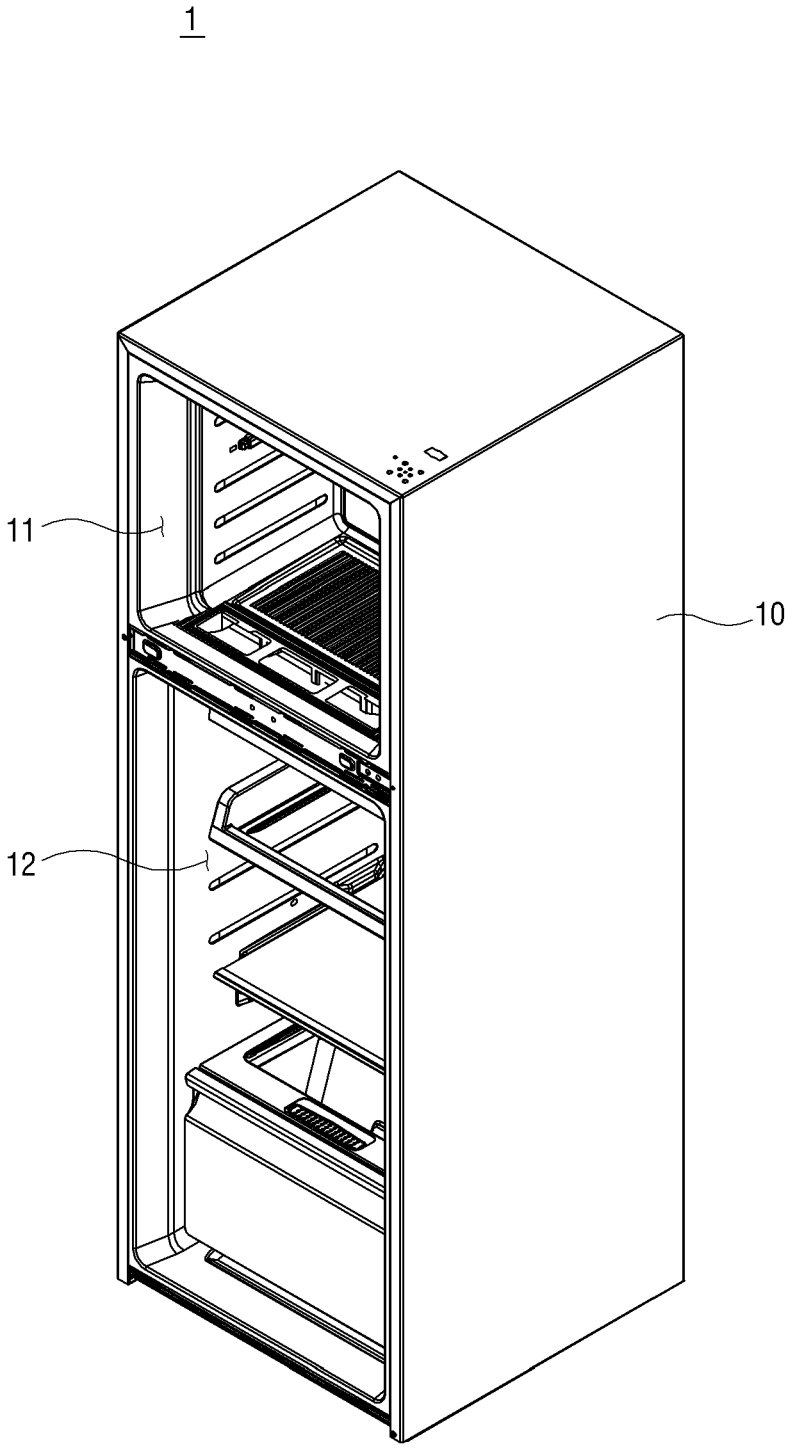
FIG. 1 schematically illustrates a refrigerator according to an embodiment of the disclosure.

Below, embodiments of the disclosure will be described in detail with reference to accompanying drawings. In the drawings, like numerals or symbols refer to like elements having substantially the same function, and the size of each element may be exaggerated for clarity and convenience of description. However, the configurations and functions illustrated in the following exemplary embodiments are not construed as limiting the present inventive concept and the key configurations and functions. In the following descriptions, details about publicly known functions or features will be omitted if it is identified that they cloud the gist of the present inventive concept.

In the disclosure, terms "have," "may have," "include," "may include," etc. indicate the presence of corresponding features (e.g., a numeral value, a function, an operation, or an element such as a part, etc.), and do not exclude the presence of additional features.

In the disclosure, terms "A or B", "at least one of A or/and B", "one or more of A or/and B" or the like may include all possible combinations of elements enumerated together. For example, "A or B", "at least one of A and B", or "at least one of A or B" may refer to all of the cases of (1) including at least one A, (2) including at least one B, or (3) including all of at least one A and at least one B.

In the disclosure, terms "first", "second", etc. are used only to distinguish one element from another, and singular forms are intended to include plural forms unless otherwise mentioned contextually.

In addition, in the disclosure, terms "upper", "lower", "left", "right", "inside", "outside", "inner", "outer", "front", "rear", etc. are defined with respect to the accompanying drawings, and do not restrict the shape or location of the elements.

Further, in the disclosure, the expression of "configured to (or set to)" may for example be replaced with "suitable for," "having the capacity to," "designed to," "adapted to," "made to," or "capable of" according to circumstances. Also, the expression of "configured to (or set to)" may not necessarily refer to only "specifically designed to" in terms of hardware. Instead, the "device configured to" may refer to "capable of" along with other devices or parts in a certain circumstance.

Figure 2:
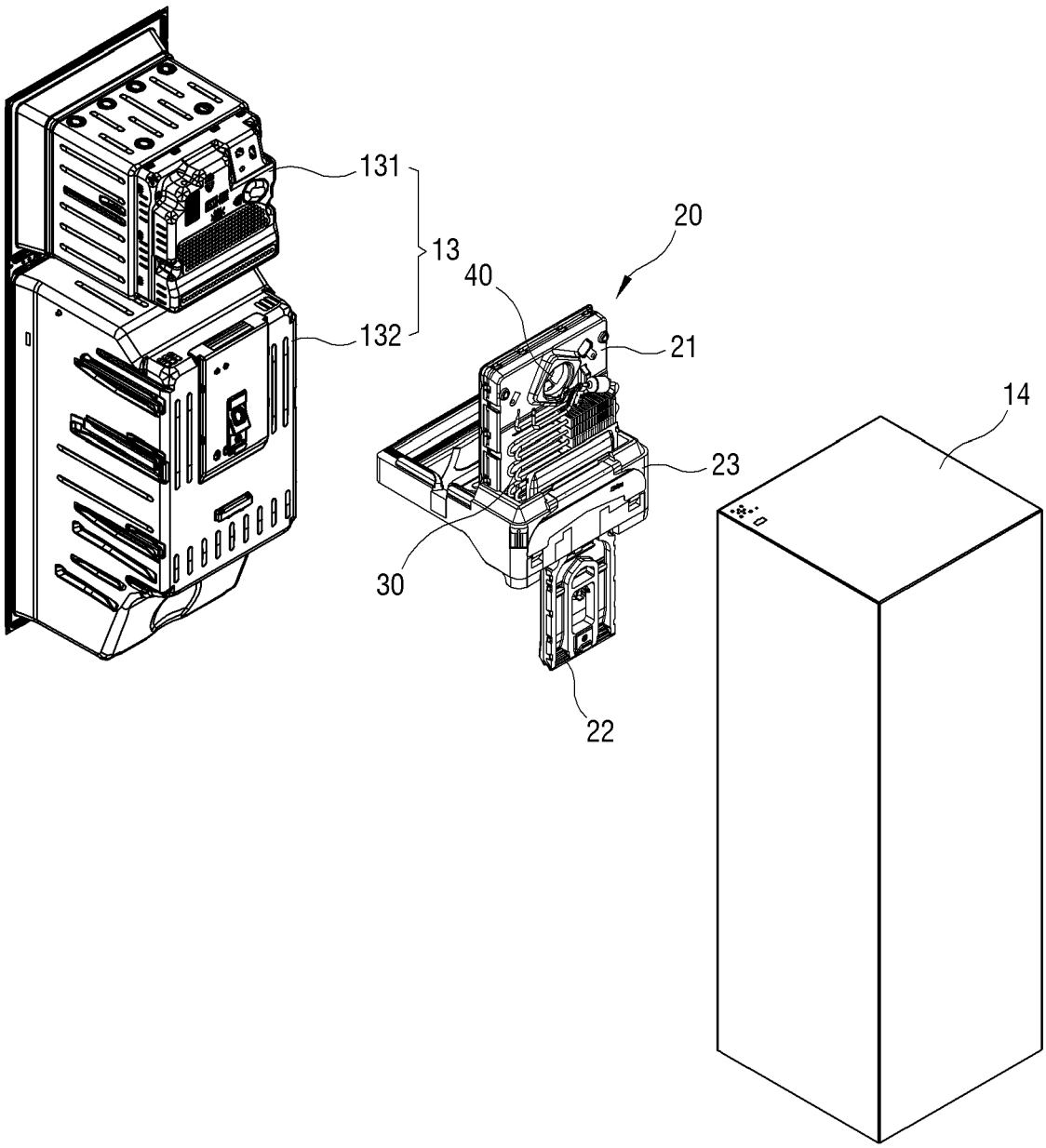
FIG. 2 is a disassembled view of the refrigerator of FIG. 1.

FIG. 1 schematically illustrates a refrigerator 1 according to an embodiment of the disclosure, and FIG. 2 is a disassembled view of the refrigerator 1 of FIG. 1. In FIG. 1, the refrigerator 1 is shown without doors.

As shown in FIGS. 1 and 2, the refrigerator 1 may include a main body 10 formed with a freezer compartment 11 and the refrigerator compartment 12, a duct assembly 20 (also referred to as a duct including a plurality of channels) for supplying cold air to the freezer compartment 11 and the refrigerator compartment 12, an evaporator 30 for generating cold air, and a fan 40 for blowing the cold air generated by the evaporator 30 through the duct assembly 20.

The main body 10 may include an inner case 13 partitioned into the freezer compartment 11 and the refrigerator compartment 12, and an outer case 14.

The inner case 13 may include a freezer compartment case 131 and a refrigerator compartment case 132.

The outer case 14 may form an outer appearance while surrounding the inner case 13.

The duct assembly 20 or duct may include first to third ducts 21, 22 and 23 formed with passages or channels along which cold air passes.

The evaporator 30 employs a refrigerant for absorbing heat from air to cool the air.

The fan 40 blows cold air generated by the evaporator 30 to the freezer compartment 11 and the refrigerator compartment 12 through the duct assembly 20.

The refrigerator 1 according to the disclosure may for example be classified into a basic refrigerator, a side-by-side refrigerator, or a 3- to 4-door refrigerator according to the number of doors and how the doors open. Further, the refrigerator 1 of the disclosure may for example be classified into a 1-EVA, 2-EVA, or 3-EVA refrigerator according to the number of evaporators for supplying cold air.

The refrigerator 1 of the disclosure may be embodied by all kinds of refrigerators including at least one of the freezer compartment 11 or the refrigerator compartment 12 according to various structures or purposes without limitation.

Figure 3:
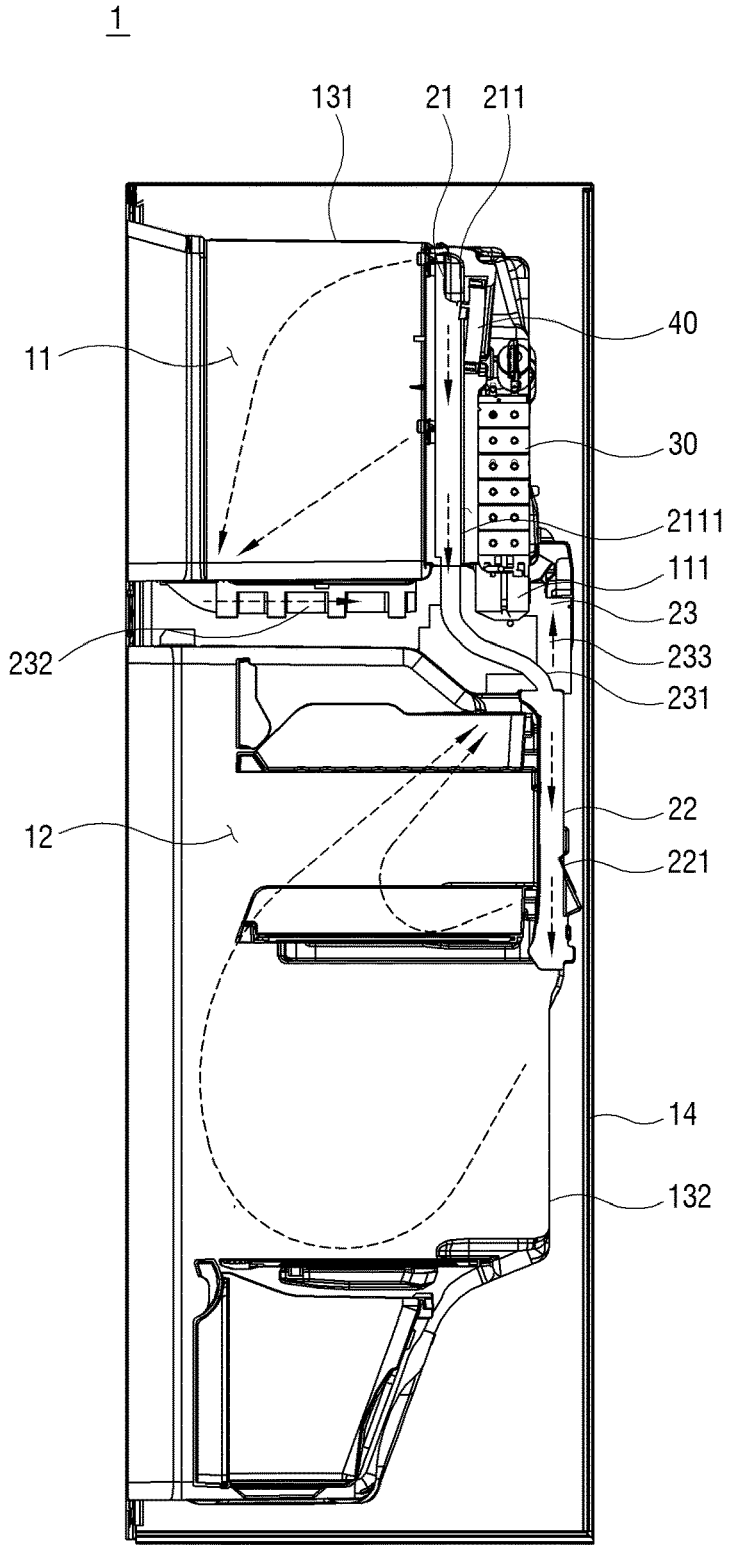
FIG. 3 illustrates flow of cold air in the refrigerator of FIG. 1.
Figure 4:
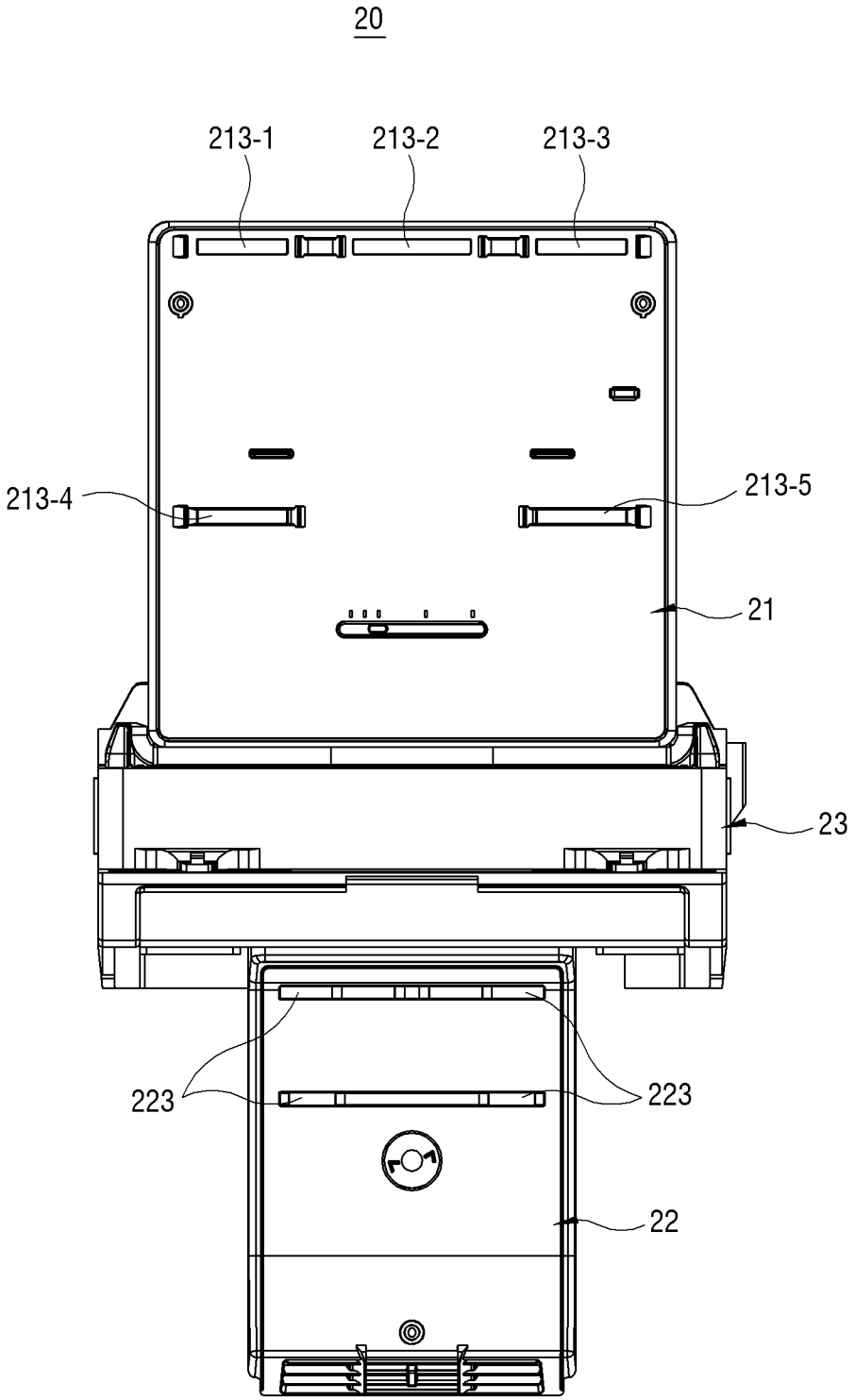
FIG. 4 illustrates a front side of a duct assembly.
Figure 5:
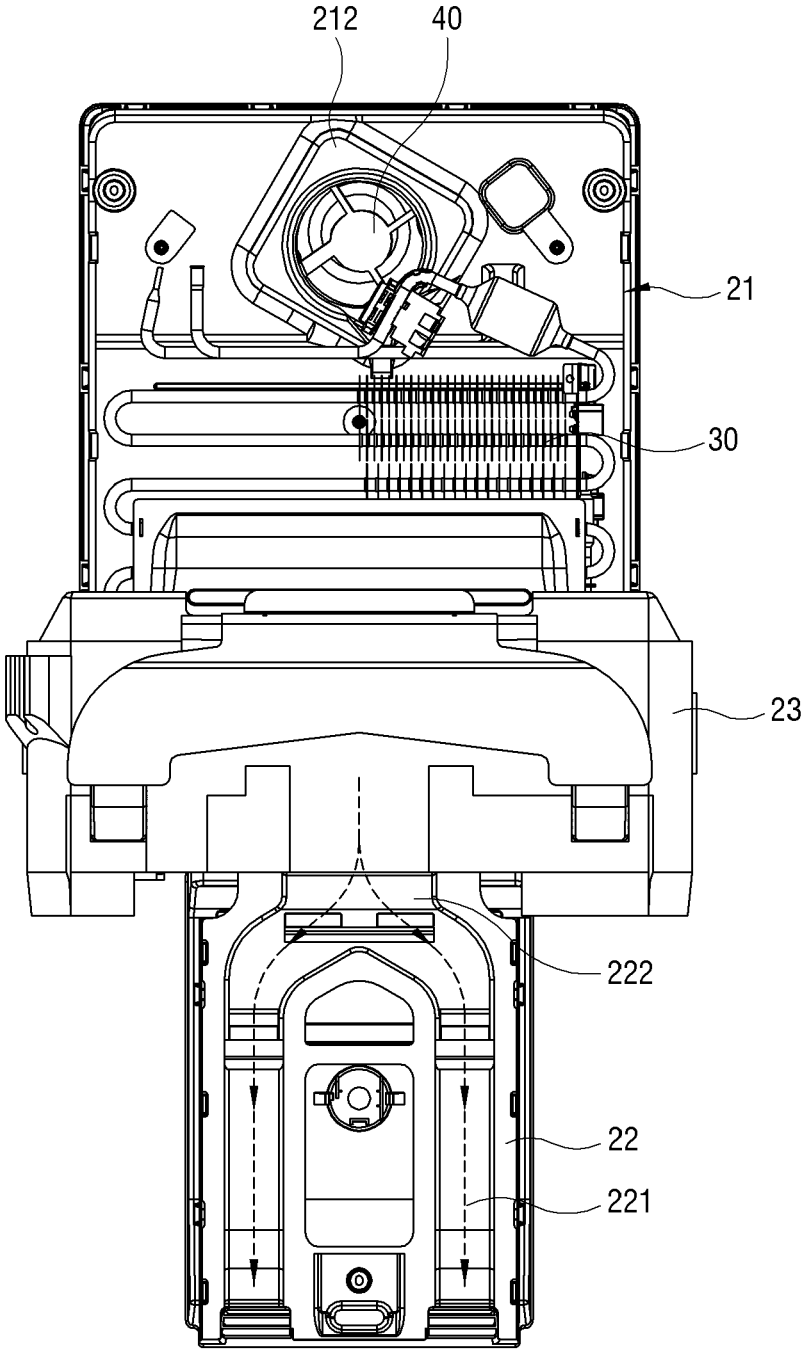
FIG. 5 illustrates a rear side of the duct assembly.
Figure 6:
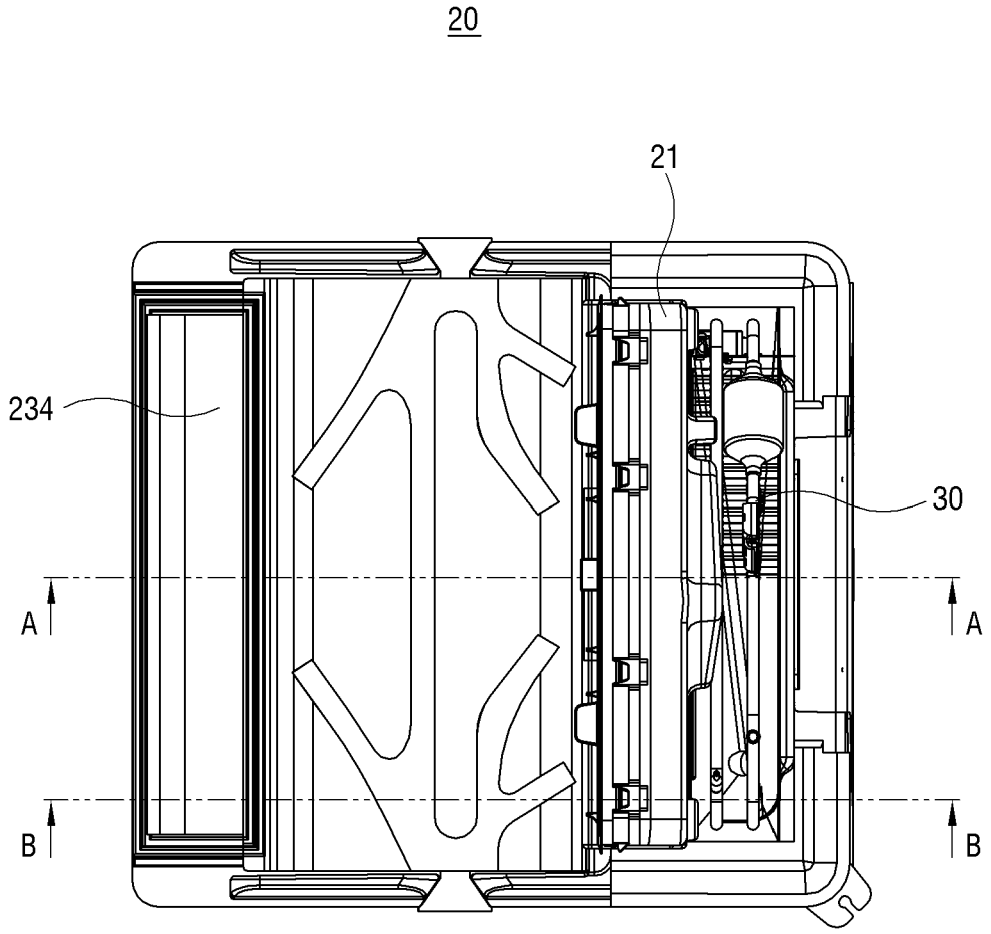
FIG. 6 illustrates the duct assembly viewed from above.
Figure 7:
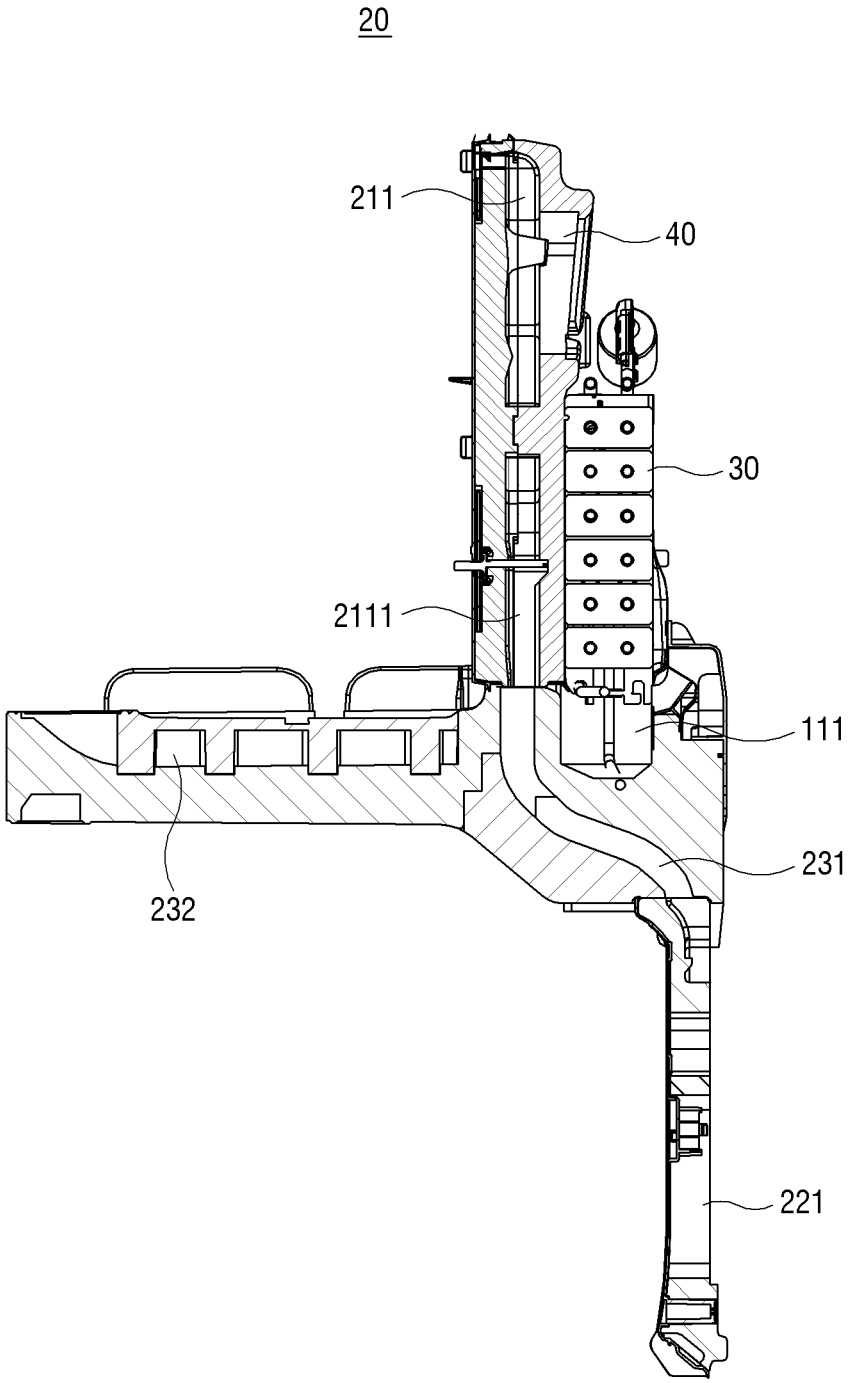
FIG. 7 illustrates a cross section taken along line A-A of FIG. 6.
Figure 8:
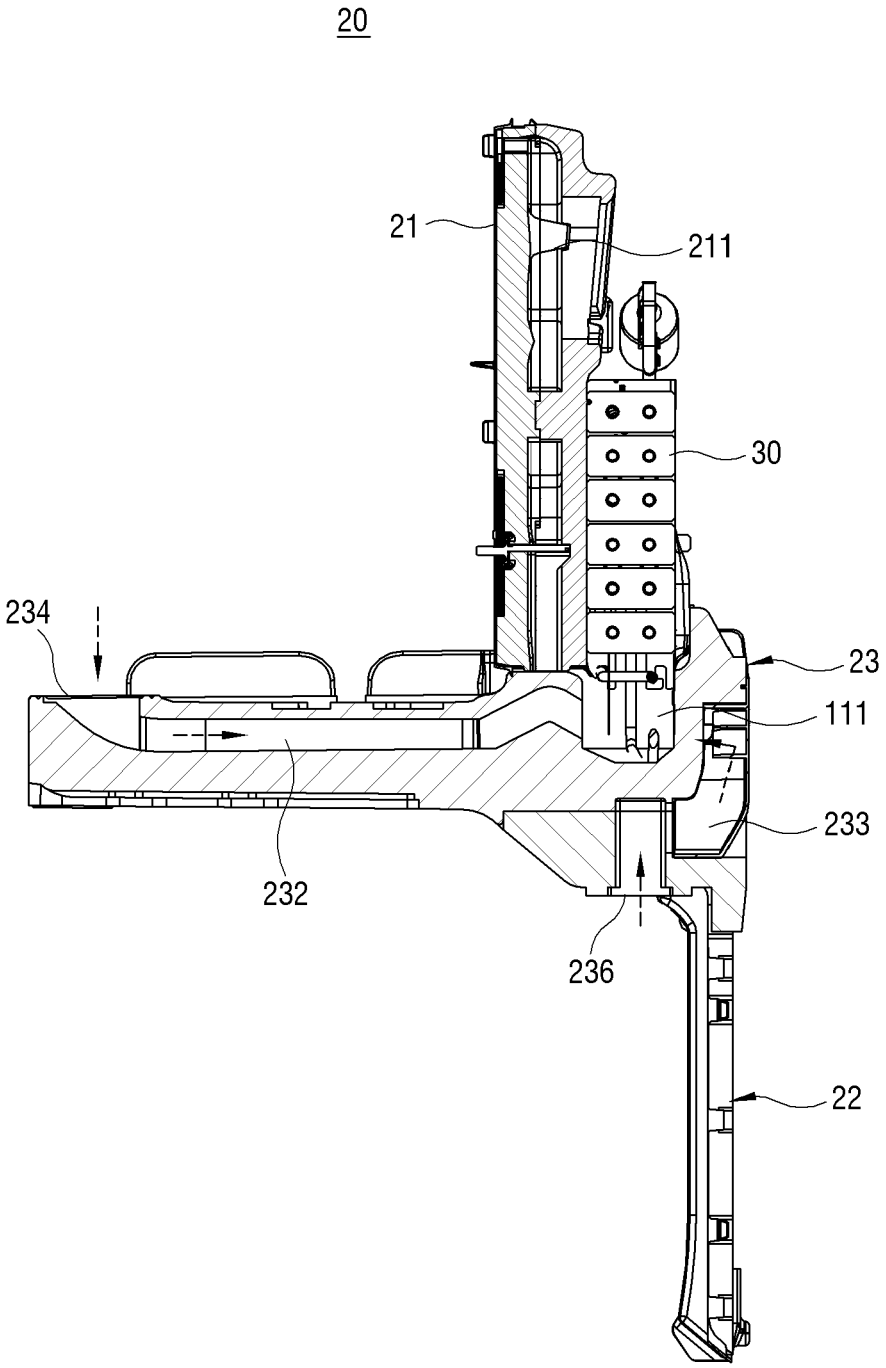
FIG. 8 illustrates a cross section taken along line B-B of FIG. 6.
Figure 9:
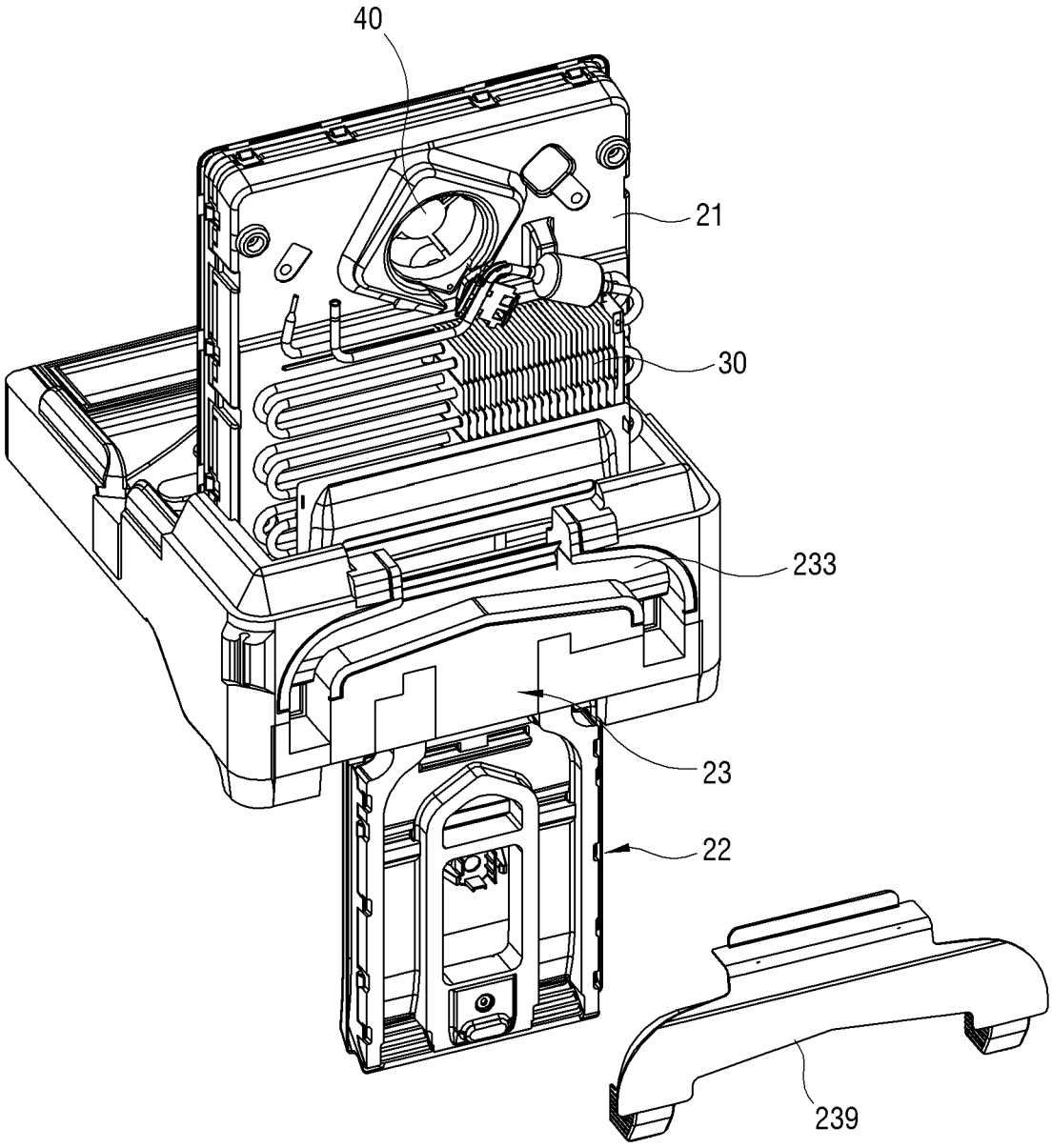
FIG. 9 illustrates a fifth channel of a third duct.

FIG. 3 illustrates flow of cold air in the refrigerator 1 of FIG. 1, FIG. 4 illustrates a front side of a duct assembly 20, FIG. 5 illustrates a rear side of the duct assembly 20, FIG. 6 illustrates the duct assembly 20 viewed from above, FIG. 7 illustrates a cross section taken along line A-A of FIG. 6, FIG. 8 illustrates a cross section taken along line B-B of FIG. 6, and FIG. 9 illustrates a fifth channel 233 of a third duct 23.

As shown in FIGS. 3 to 7, the duct assembly 20 may include a first duct 21 placed behind the freezer compartment 11 inside the freezer compartment case 131, a second duct 22 placed behind the refrigerator compartment 12 inside the refrigerator compartment case 132 and carrying cold air into the refrigerator compartment 12, and a third duct 23 carrying air from the freezer compartment 11 and the refrigerator compartment 12 to the evaporator 30. Behind the first duct 21, a cold-air generating space 111 is provided. The evaporator 30 may be placed in the cold-air generating space 111.

The first duct 21 may include a first channel 211 for guiding cold air from the cold-air generating space 111 to the freezer compartment 11 through the fan 40. The first channel 211 may include five first to fifth cold-air outlets 213-1~213-5 (see FIG. 4) into which cold air from the cold-air generating space 111 flows and through which cold air of the first channel 211 and a first cold-air inlet 212 (see FIG. 5) provided with the fan 40 is discharged to the freezer compartment 11. The first channel 211 may include a connection channel 2111 for carrying cold air to the second duct 22. The first channel 211 may refer to all the passages from the first cold-air inlet 212 to the first to fifth cold-air outlets 213-1~213-5 and the connection channel 2111.

The second duct 22 may include a second channel 221 for guiding some of the cold air from the first channel 211 into the refrigerator compartment 12. The second duct 22 may include a plurality of cold-air outlets 223 (see FIG. 4) to discharge cold air from the second channel 221 and the second cold-air inlet 222 (see FIG. 5), into which the cold air flows via the first duct 21 and the third duct 23, to the refrigerator compartment 12.

The third duct 23 may, as shown in FIGS. 7 and 8, include a third channel 231 for connecting the first channel 211 and the second channel 221, a fourth channel 232 for guiding air from the freezer compartment 11 to the cold-air generating space 111, and the fifth channel 233 for guiding air from the refrigerator compartment 12 to the cold-air generating space 111.

The third duct 23 may, as shown in FIG. 8, include a third cold-air inlet 234 into which air absorbing heat from the freezer compartment 11 flows. The air flowing into the third cold-air inlet 234 may be discharged to the cold-air generating space 111 through the fourth channel 232.

The third duct 23 may, as shown in FIG. 8, include a fourth cold-air inlet 236 into which air absorbing heat from the refrigerator compartment 12 flows. The air flowing into the fourth cold-air inlet 236 may be discharged to the cold-air generating space 111 through the fifth channel 233.

The fifth channel 233 may, as shown in FIG. 9, be formed by covering a recessed back of the third duct 23 with a channel cover 239.

Figure 10:
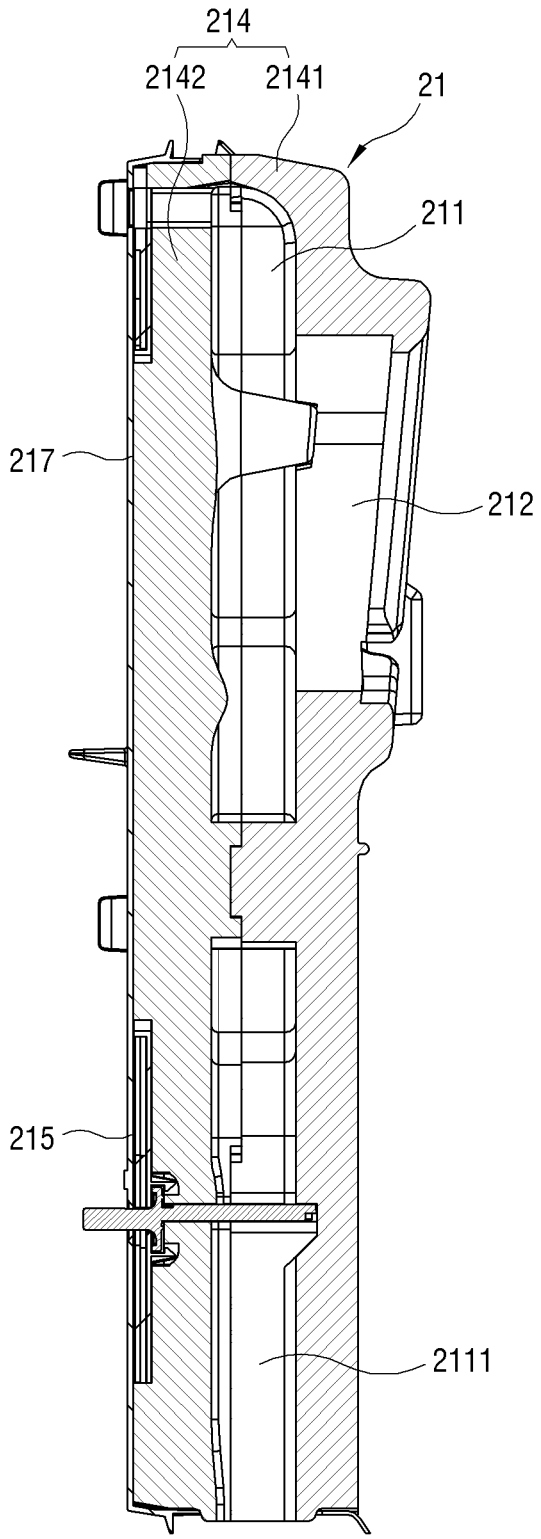
FIG. 10 illustrates a first duct of FIG. 8.
Figure 11:
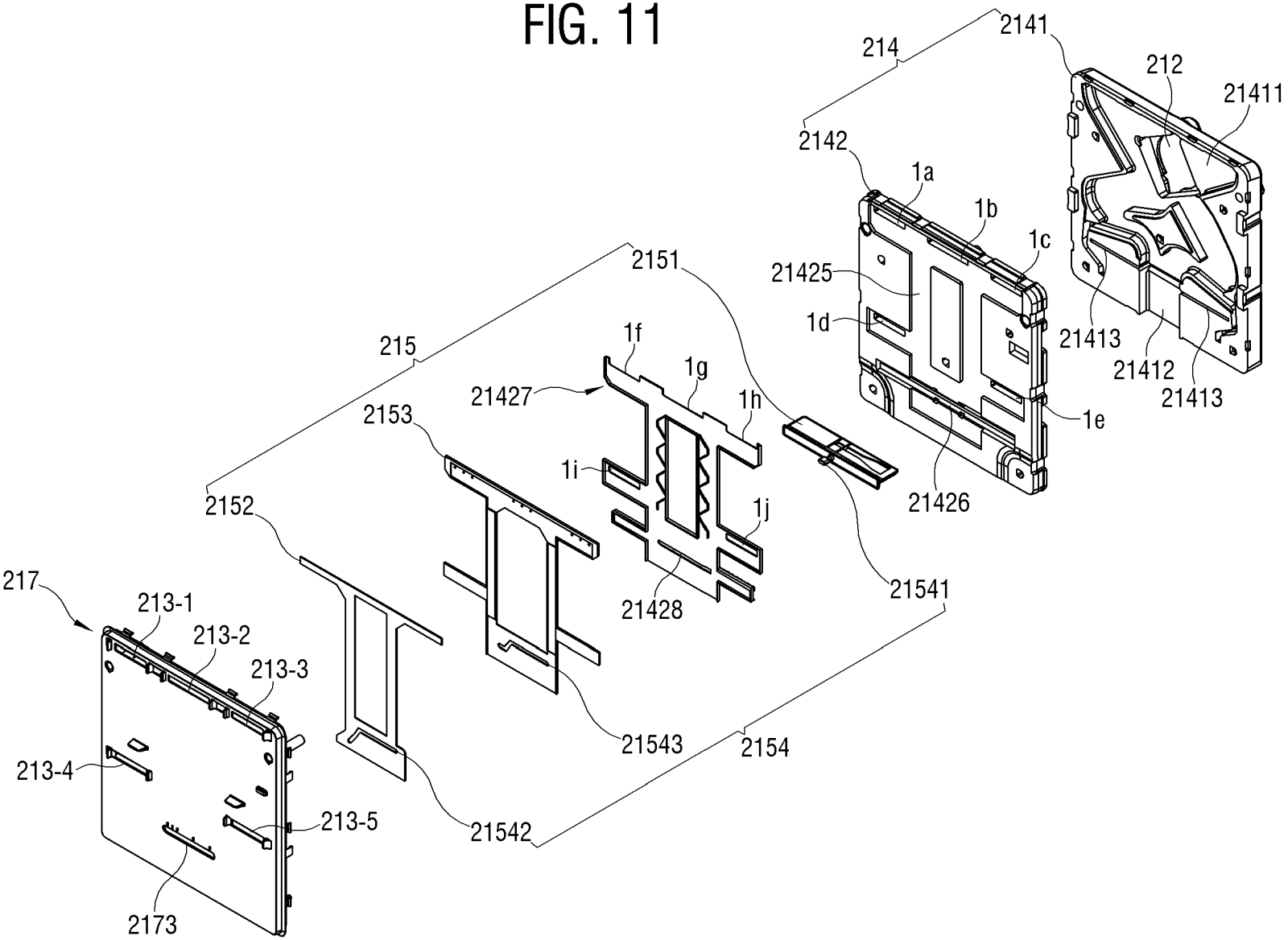
FIG. 11 is an exploded perspective view of the first duct viewed from the front.
Figure 12:
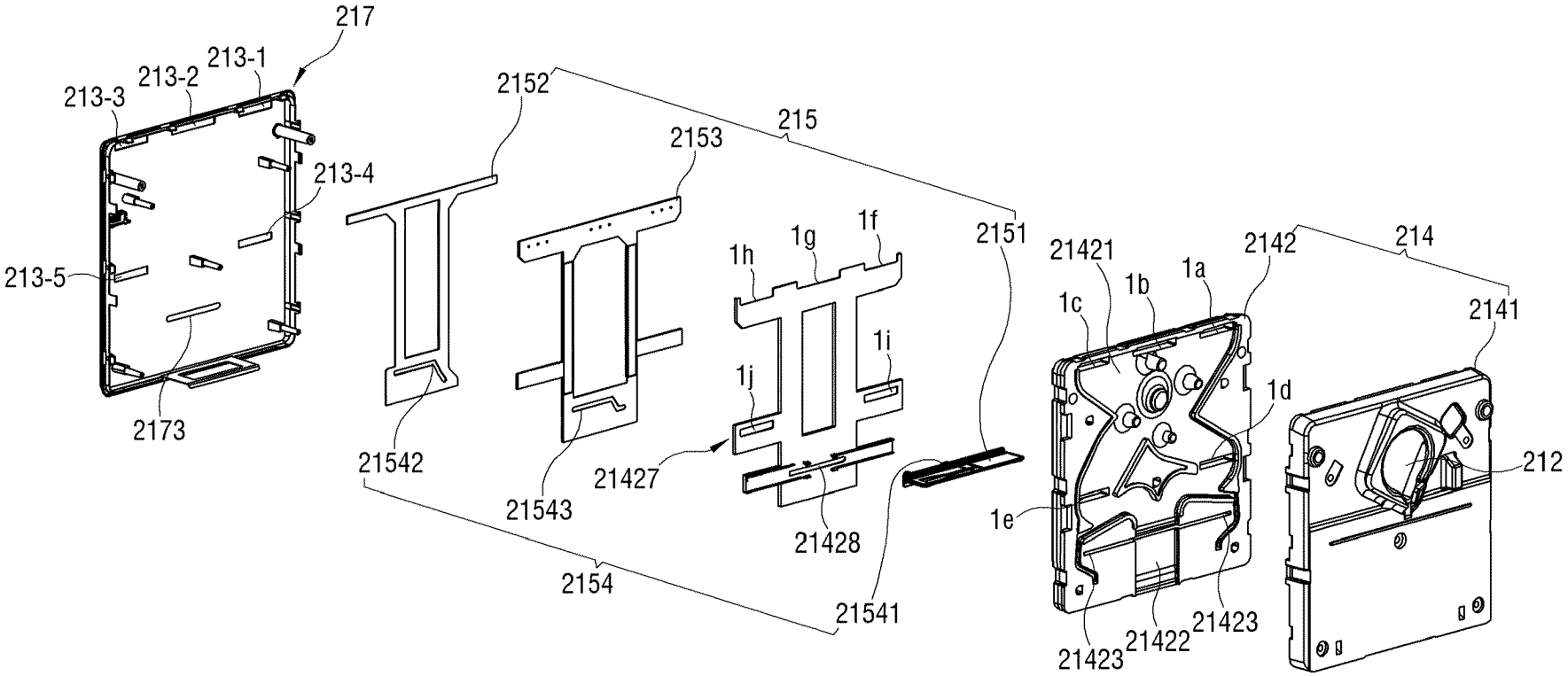
FIG. 12 is an exploded perspective view of the first duct viewed from the back.
Figure 13:
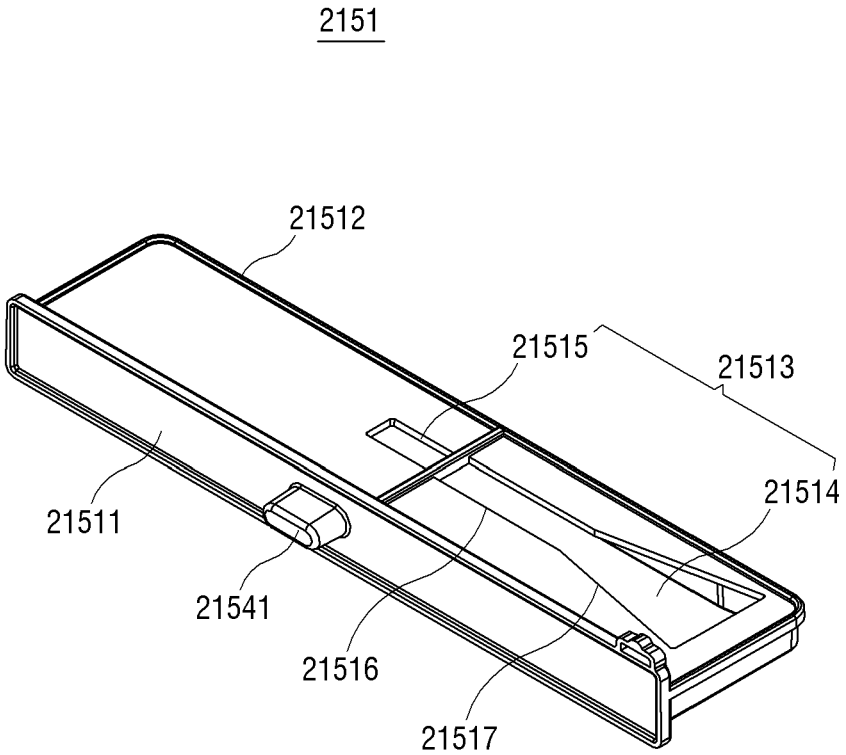
FIG. 13 is a perspective view of a first shutter.
Figure 14:
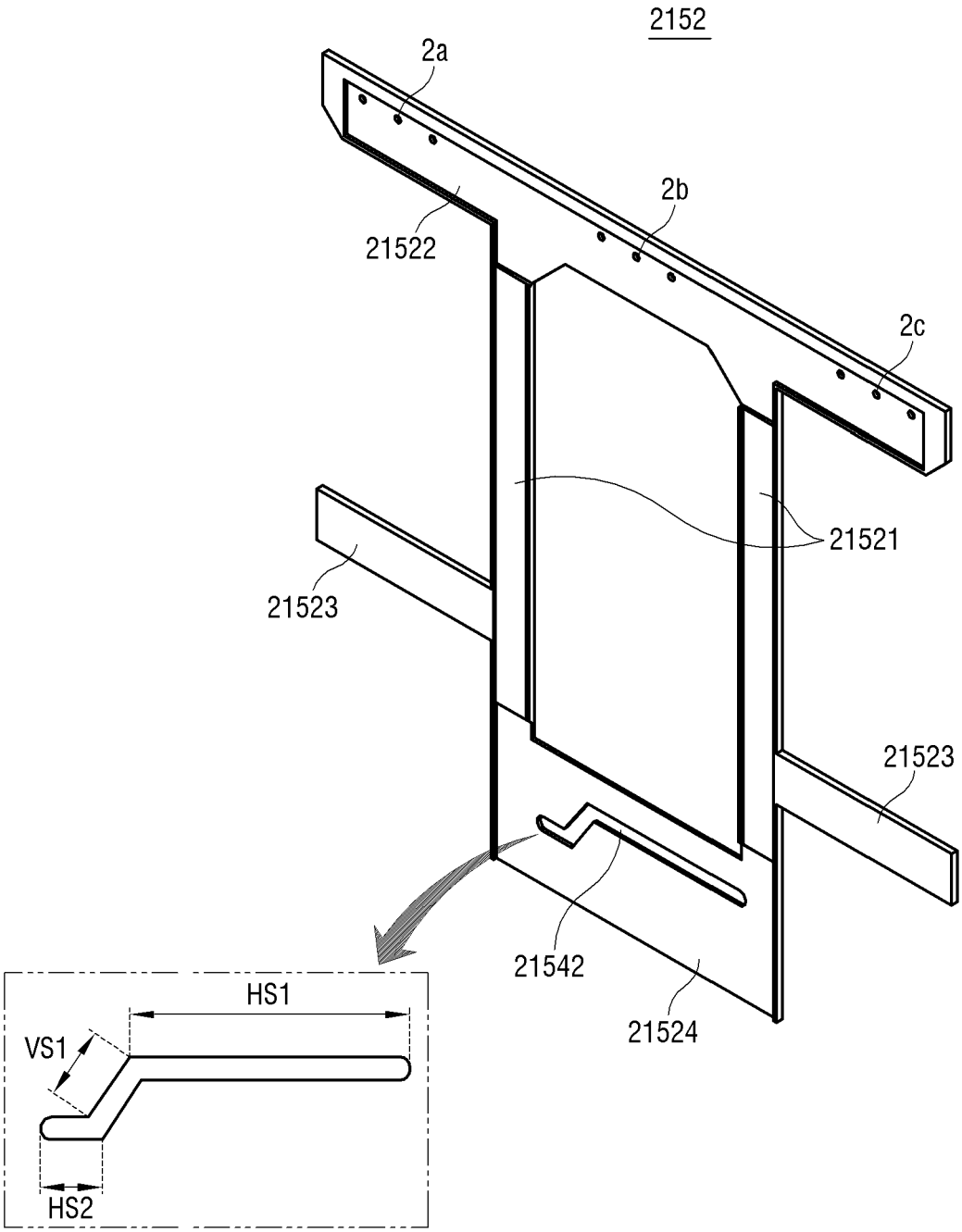
FIG. 14 is a perspective view of a second shutter.
Figure 15:
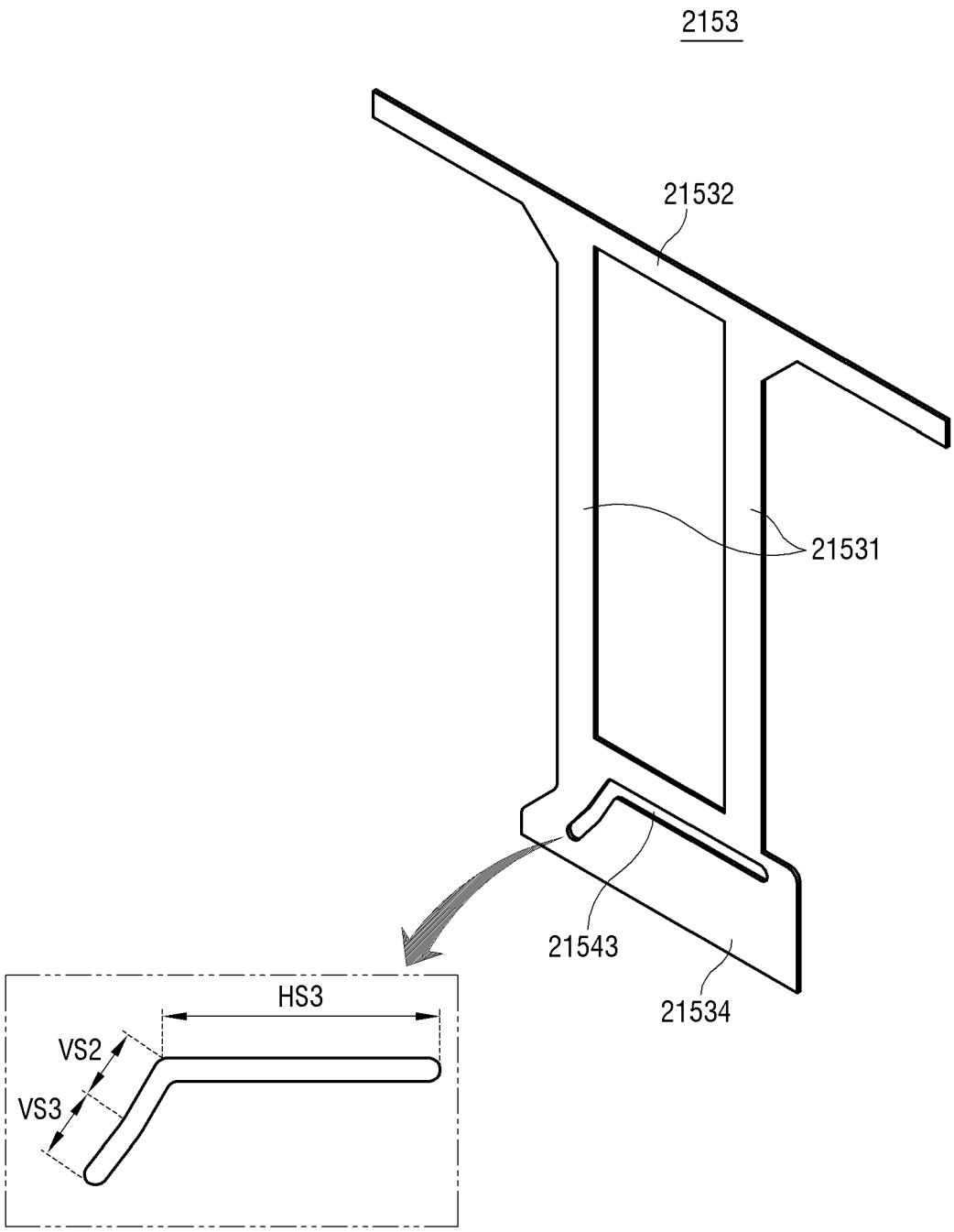
FIG. 15 is a perspective view of a third shutter.

FIG. 10 illustrates the first duct 21 of FIG. 8, FIG. 11 is an exploded perspective view of the first duct 21 viewed from the front, FIG. 12 is an exploded perspective view of the first duct 21 viewed from the back, FIG. 13 is a perspective view of a first shutter 2151 (also referred to as a damper, an open/close member, opening/closing member, an open or close member and a mechanical switch), FIG. 14 is a perspective view of a second shutter 2152, and FIG. 15 is a perspective view of a third shutter 2153.

As shown in FIGS. 10 to 12, the first duct 21 may include a channel former 214 internally formed with the first channel 211, a cold-air adjuster 215 for adjusting the amount of cold air supplied to the freezer compartment 11 and the refrigerator compartment 12, and a mounting cover 217 for mounting the cold-air adjuster 215 to the channel former 214.

The channel former 214 may include first and second channel members 2141 and 2142 shaped like plates to couple with each other internally forming the first channel 211 (see FIG. 10).

The first channel member 2141 may be placed at the side of the evaporator 30 (see FIG. 5). The first channel member 2141 may include the cold-air inlet 212 penetrating an upper portion thereof, a first channel groove 21411 recessed on a side facing toward the second channel member 2142, a first connection channel groove 21412, and a first guide groove 21413 crossing the first connection channel groove 21412.

The second channel member 2142 may include a second channel groove 21421 recessed on a side facing the first channel member 2141, a second connection channel groove 21422, and a second guide groove 21423 crossing the second connection channel groove 21422.

The first and second channel grooves 21411 and 21421 may interlock with each other to form the first channel 211 (see FIG. 10).

The first and second connection channel grooves 21412 and 21422 may interlock with each other to form the connection channel 2111 (see FIG. 10). The connection channel 2111 may guide cold air from the first channel 211 to the third channel 231 (see FIG. 7) of the third duct 23.

The first and second guide grooves 21413 and 21423 may interlock with each other so that the first shutter 2151 of the cold-air adjuster 215 (to be described later) can be inserted therebetween and move horizontally.

The second channel member 2142 may communicate with the second channel groove 21421, and include first to third cold-air exits 1*a*~1*c* penetrating an upper portion and fourth and fifth cold-air exits 1*d* and 1*e* penetrating a middle portion.

The second channel member 2142 may include a guide mounting groove 21425 recessed on a side facing the mounting cover 217, a shutter guide 21427 mounted to the guide mounting groove 21425, and a shutter mounting hole 21426 for mounting the first shutter 2151 of the cold-air adjuster 215.

The shutter mounting hole 21426 may be formed in the guide mounting groove 21425. The shutter mounting hole 21426 allows the first shutter 2151 to be mounted to the first and second guide grooves 21413 and 21423. Further, the first to fifth cold-air exits 1*a*~1*e* may also be provided in the guide mounting groove 21425.

The shutter guide 21427 may be mounted with second and third shutters 2151~2153. The shutter guide 21427 may include first to fifth communication openings 1*f*~1*j* placed corresponding to the first to fifth cold-air exits 1*a*~1*e*, and a knob guide 21428 placed corresponding to the shutter mounting hole 21426. The shutter guide 21427 may is as big as the second and third shutters 2152 and 2153 of the cold-air adjuster 215 mounted thereto are allowed to move up and down.

The knob guide 21428 may be shaped like a slot elongated in a horizontal direction. The knob guide 21428 may be formed so that a knob 21541 of a manipulator 2154 (also referred to as an actuator) inserted therein can protrude toward the mounting cover 217. The knob 21541 of the manipulator 2154 may be operated by a user to move in a horizontal direction, in other words, right and left along the knob guide 21428.

According to an alternative embodiment, the shutter guide 21427 may be omitted, and the surface of the second channel member 2142 may serve as the shutter guide 21427. In this case, the first shutter 2151 may be assembled together when the first channel member 2141 and the second channel member 2142 are coupled.

The cold-air adjuster 215 may include the first shutter 2151 provided in the connection channel 2111 (see FIG. 10) for carrying cold air to the refrigerator compartment 12, the second and third shutters 2152 and 2153 provided in the shutter guide 21427, and the manipulator 2154 provided in the first to third shutters 2151~2153.

The first shutter 2151 moves in the horizontal direction to adjust the cross-sectional area of the connection channel 2111 (see FIG. 10) through which cold air is supplied to the refrigerator compartment 12.

Referring to FIG. 13, the first shutter 2151 may include a front frame 21511 shaped like a plate standing at one side, a rear frame 21512 shaped like a plate extended in a direction perpendicular to the surface of the front frame 21511, and a cold-air through hole 21513 formed penetrating the rear frame 21512. The cold-air through hole 21513 may include a main cold-air through hole 21514, and a sub cold-air through hole 21515. The main cold-air through hole 21514 may include a linearly extended portion 21516 extended having a predetermined width, and a widening portion 21517 gradually widened from the linearly extended portion 21516 as a single body.

The first shutter 2151 may include the knob 21541 protruding frontward from the center of the front frame 21511.

The second shutter 2152 may move in a vertical direction to adjust the effective sizes of the first to fifth cold-air outlets 213-1~213-5 (see FIG. 11) through which cold air is discharged to the freezer compartment 11.

As described above, a refrigerator according to the disclosure includes a plurality of shutters to adjust cold air supplied to a plurality of storage compartments, in which a manipulator for one shutter among the plurality of shutters is usable for operating another shutter through interlocking. In this way, a refrigerator according to the disclosure is free from problems of a user's confusion or malfunction because one manipulator is used to adjust cold air of a freezer compartment or a refrigerator compartment.

Referring to FIG. 14, the second shutter 2152 includes a pair of columns 21521 shaped like plates spaced apart from each other and extended in a first direction, a first horizontal bar 21522 extended from the first ends of the pair of columns 21521 in a second direction perpendicular to the first direction, a second horizontal bar 21523 extended from the second ends of the pair of columns 21521 in the second direction, and a first slot former 21524 into which second ends of the pair of columns 21521 are integrated and which is extended in a direction opposite to the first direction. The first slot former 21524 may include a first guide slot 21542.

The first horizontal bar 21522 may include first to third opening holes **2*a*~2*c* smaller than the first to third cold-air outlets 213-1~213-3 (see FIG. 11). The first to third opening holes 2*a*~2*c* may be embodied by a plurality of opening holes or a single opening hole. The first to third opening holes 2*a*~2*c* overlap with the first to third cold-air outlets 213-1~213-3 when the second shutter 2152 moves in the first direction, thereby decreasing the amount of cold air discharged through the first to third cold-air outlets 213-1~213-3**.

The second horizontal bar 21523 is shaped like a plate and overlaps with the fourth and fifth cold-air outlets 213-4~213-5 when the second shutter 2152 moves in the first direction, thereby shutting off cold air discharged through the fourth and fifth cold-air outlets 213-4~213-5.

According to an alternative embodiment, the second horizontal bar 21523 may include an opening hole smaller than the fourth and fifth cold-air outlets 213-4 and 213-5 like the first horizontal bar 21522. In this case, the second horizontal bar 21523 may decrease the amount of discharged cold air without completely blocking up the fourth and fifth cold-air outlets 213-4~213-5 when the second shutter 2152 moves up.

The third shutter 2153 may move to open or block the first to third cold-air outlets 213-1~213-3 through which cold air is discharged to the freezer compartment 11.

Referring to FIG. 15, the third shutter 2153 includes a pair of columns 21531 shaped like plates spaced apart from each other and extended in the first direction, a third horizontal bar 21532 extended from first ends of the pair of columns 21531 in the second direction, and a second slot former 21534 into which second ends of the pair of columns 21531 are integrated and which is extended in a direction opposite to the first direction. The second slot former 21534 is formed with a second guide slot 21543.

The third horizontal bar 21532 is provided as a plate and overlaps with the first to third cold-air outlets 213-1~213-3 when the third shutter 2153 moves and operates in the first direction, thereby shutting off cold air discharged through the first to third cold-air outlets 213-1~213-3. Of course, the third horizontal bar 21532 may block up the first to third opening holes **2*a*~2*c* formed in the first horizontal bar 21522 of the overlapping second shutter 2152, instead of directly blocking up the first to third cold-air outlets 213-1~213-3**.

According to an alternative embodiment, the third shutter 2153 may further include an additional horizontal bar corresponding to the second horizontal bar 21523 of the second shutter 2152. In this case, the additional horizontal bar may block up a small opening hole when the small opening hole is formed in the second horizontal bar 21523 of the second shutter 2152.

The manipulator 2154 may, as shown in FIG. 12, include the knob 21541 provided in the first shutter 2151, the first guide slot 21542 formed in the second shutter 2152, and the second guide slot 21543 formed in the third shutter 2153.

The knob 21541 may, as shown in FIG. 13, protrude from the front frame 21511 of the first shutter 2151 in a perpendicular direction. The protruding knob 21541 protrudes inside the freezer compartment 11 and is manipulated by a user.

The first guide slot 21542 may, as shown in FIG. 14, include a first horizontal slot HS1 elongated on the first slot former 21524 in a first horizontal direction, a first inclined slot VS1 integrally elongated from a first end of the first horizontal slot HS1 in a first inclined direction, and a second horizontal slot HS2 integrally elongated from a first end of the first inclined slot VS1 in a second horizontal direction.

The second guide slot 21543 may, as shown in FIG. 15, include a third horizontal slot HS3 elongated on the second slot former 21534 in the first horizontal direction, and a second inclined slot VS2 and a third inclined slot VS3 integrally elongated from a first end of the third horizontal slot HS3 in the second inclined direction. The third inclined slot VS3 is elongated beyond the first inclined slot VS1, and the second guide slot 21543 includes the third inclined slot VS3 without the second horizontal slot HS2 unlike the first guide slot 21542. Therefore, when the knob 21541 horizontally moves for the off mode of the freezer compartment, the second shutter 2152 is guided along the second horizontal slot HS2, thereby moving the third shutter 2153 along the third inclined slot VS3 in the first direction without moving the second shutter 2152.

Referring back to FIGS. 11 and 12, the mounting cover 217 and the channel former 214 may be coupled to each other with the cold-air adjuster 215 therebetween.

The mounting cover 217 may be exposed in the freezer compartment 11. The mounting cover 217 may include the first to fifth cold-air outlets 213-1~213-5 respectively communicating with the first to fifth cold-air exits **1*a*~1*e* of the second channel member 2142, and the knob hole 2173 in which the knob 21541** is accommodated to be manipulated from side to side.

Below, the operations of the cold-air adjuster 215 will be described with reference to FIGS. 16 to 23.

Figure 16:
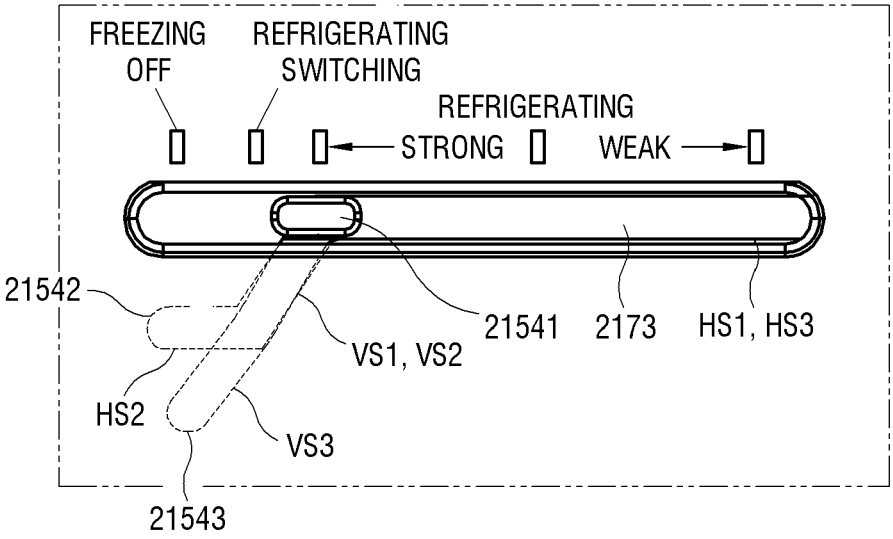
FIG. 16 illustrates a manipulator.
Figure 17:
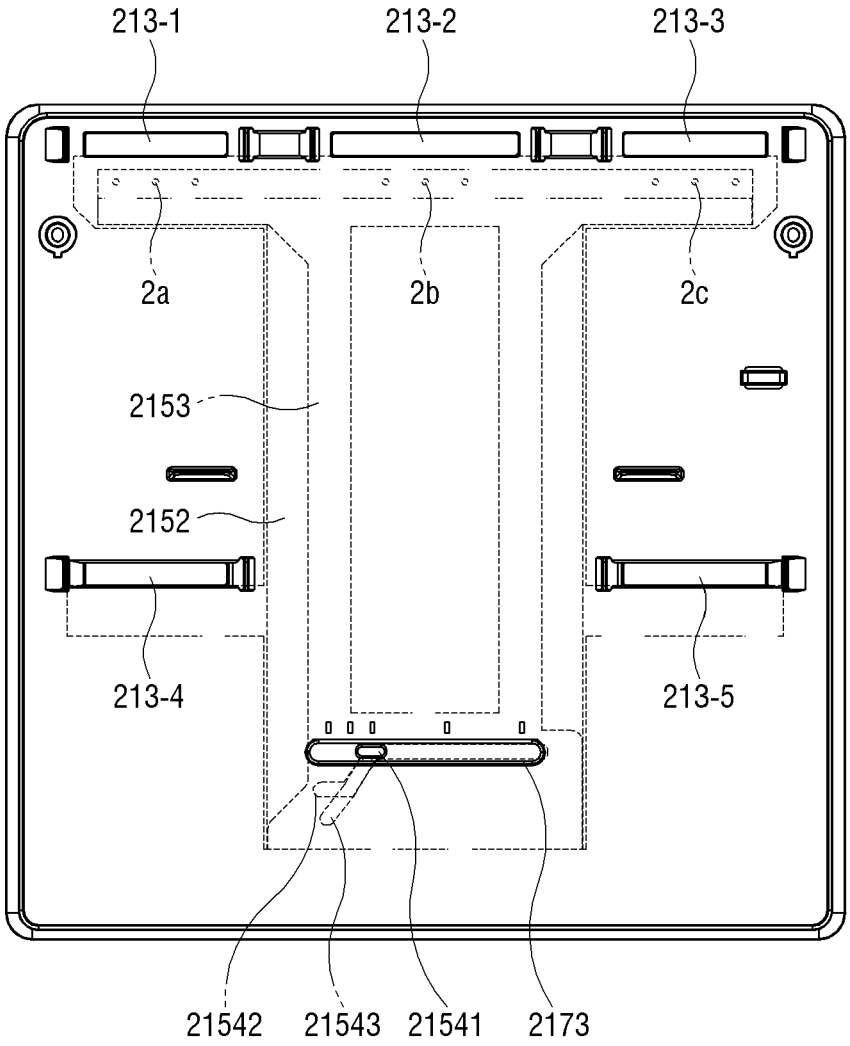
FIG. 17 illustrates the first duct viewed from the front.
Figure 18:
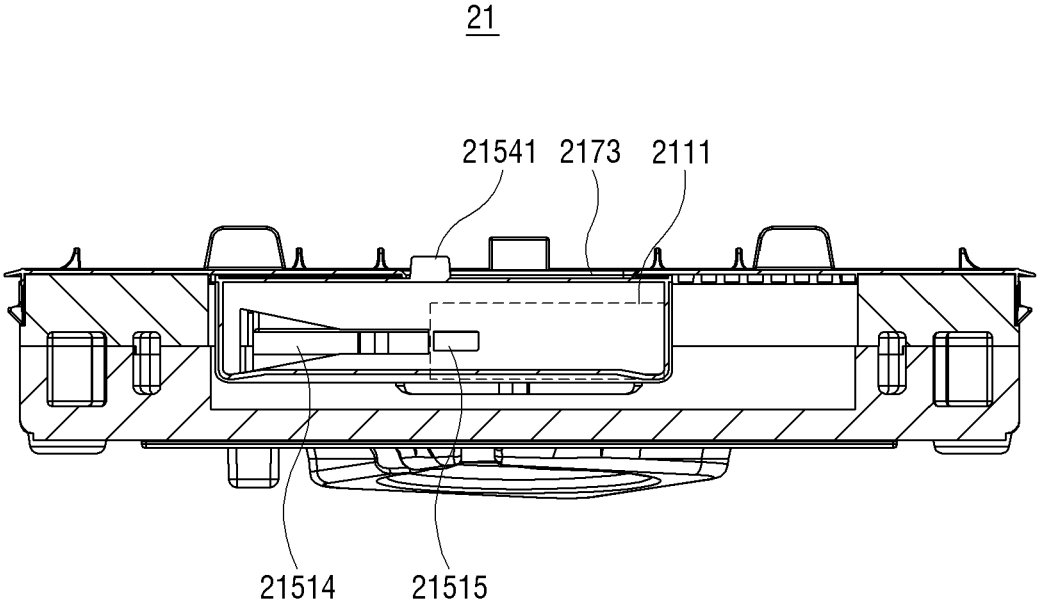
FIG. 18 illustrates a first cold-air adjusting mode for a refrigerator compartment.
Figure 19:
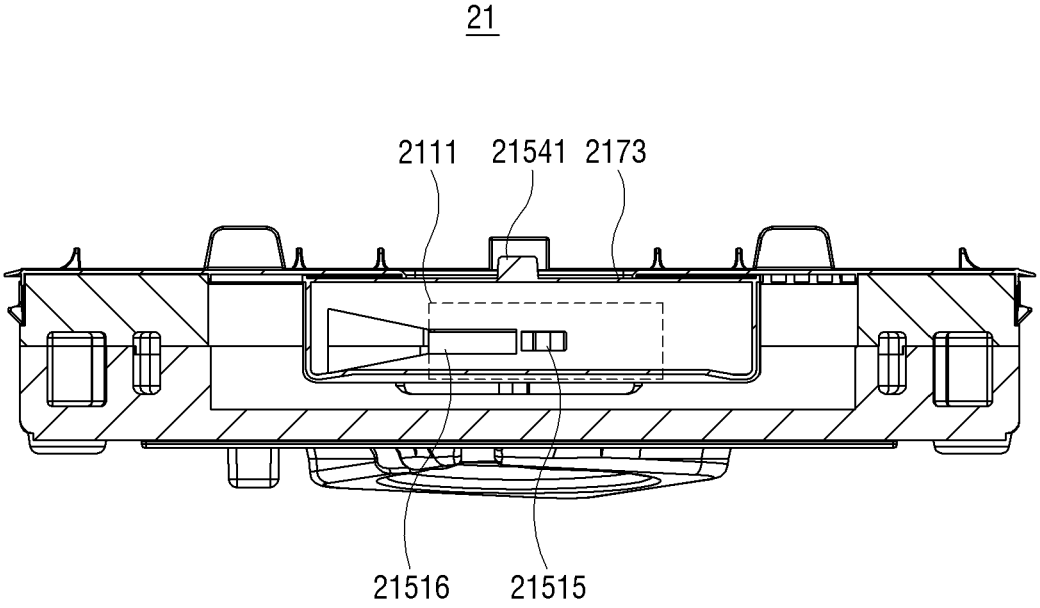
FIG. 19 illustrates a second cold-air adjusting mode for the refrigerator compartment.
Figure 20:
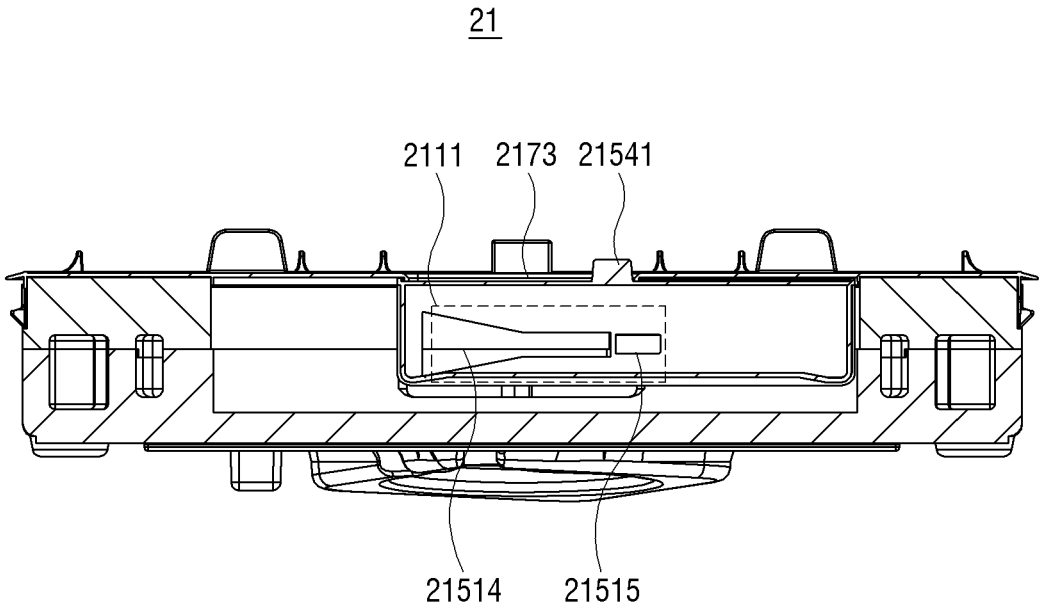
FIG. 20 illustrates a third cold-air adjusting mode for the refrigerator compartment.
Figure 21:
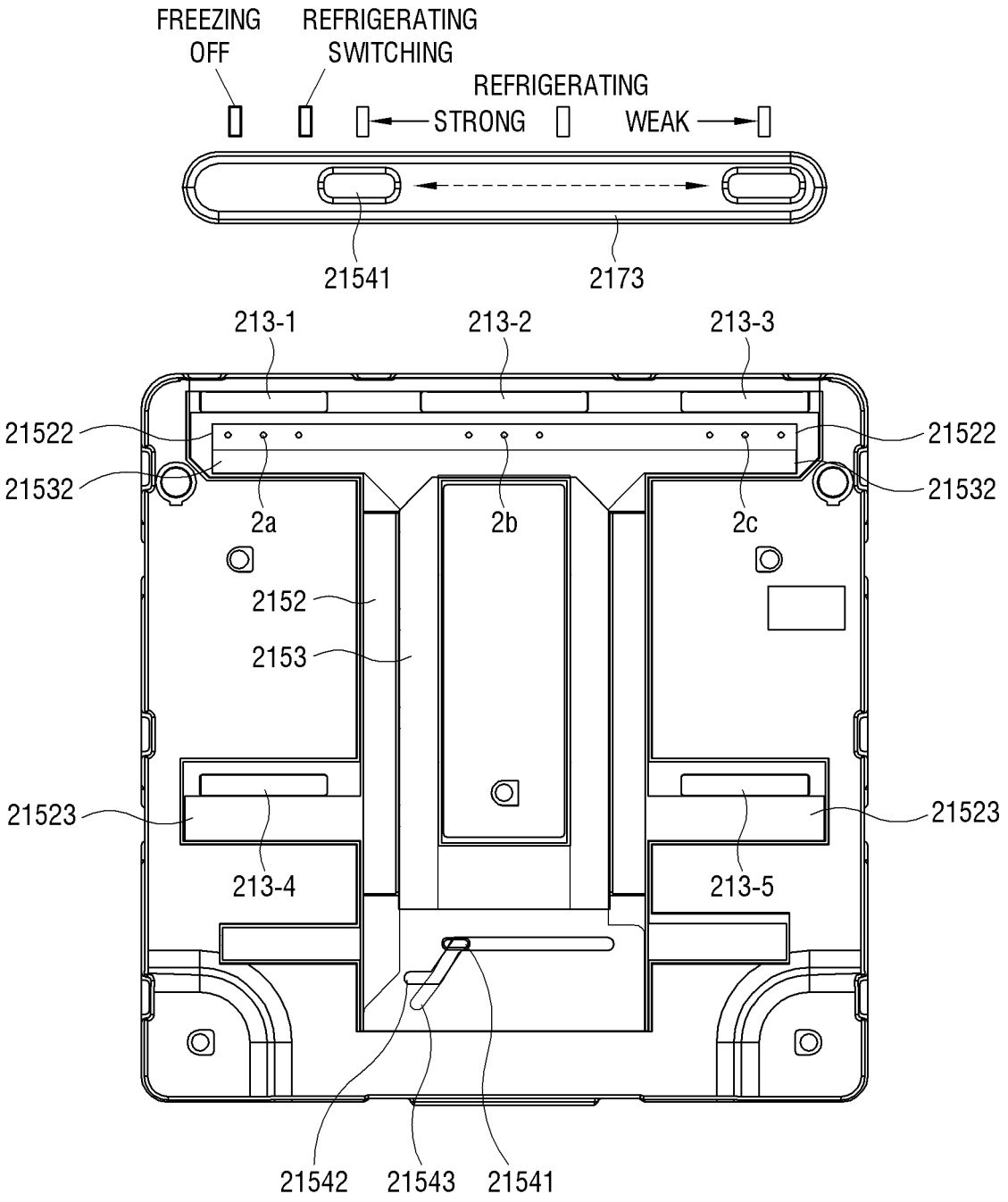
FIG. 21 illustrates a freezing mode for a freezer compartment.
Figure 22:
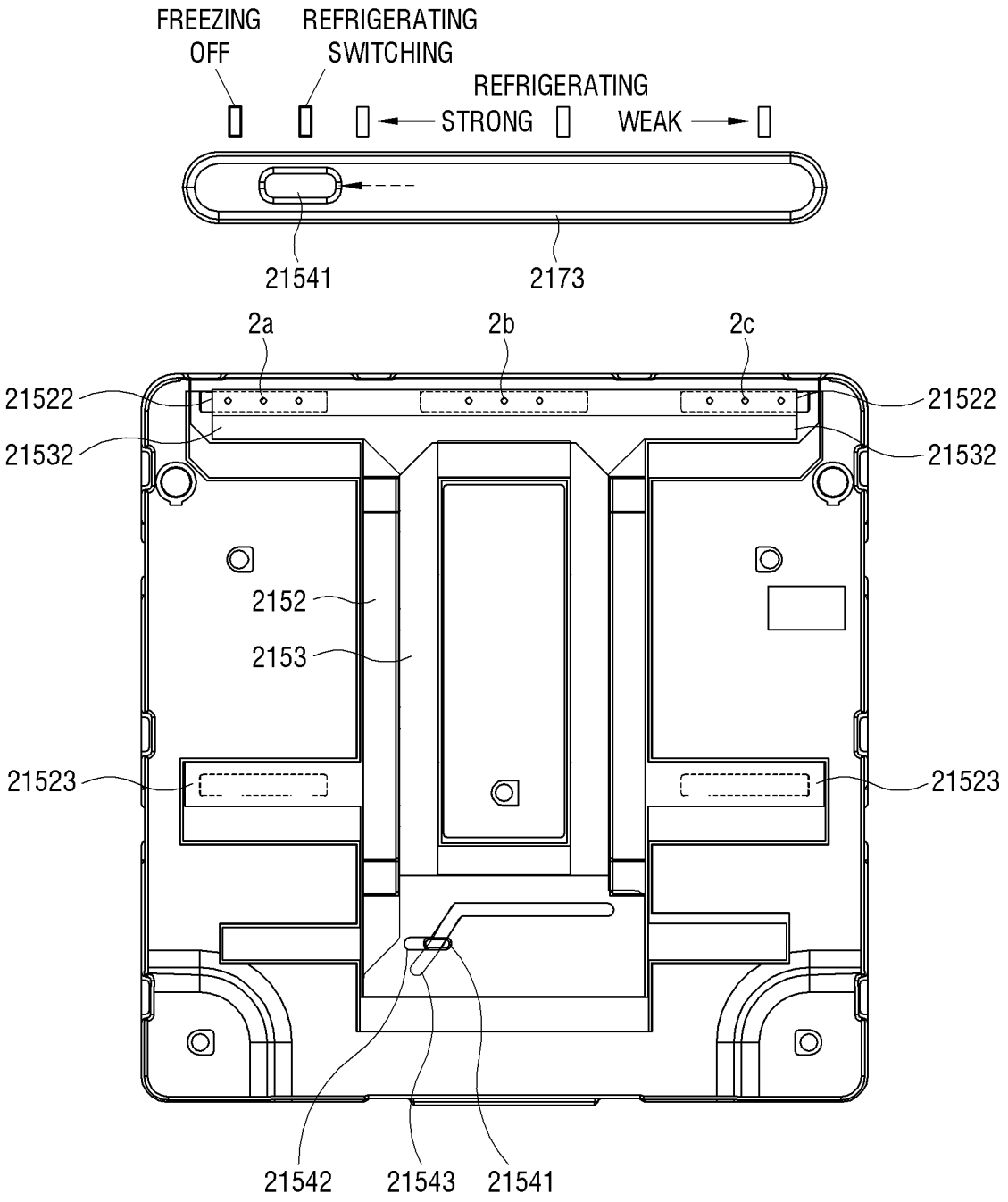
FIG. 22 illustrates a refrigeration switching mode for the freezer compartment.
Figure 23:
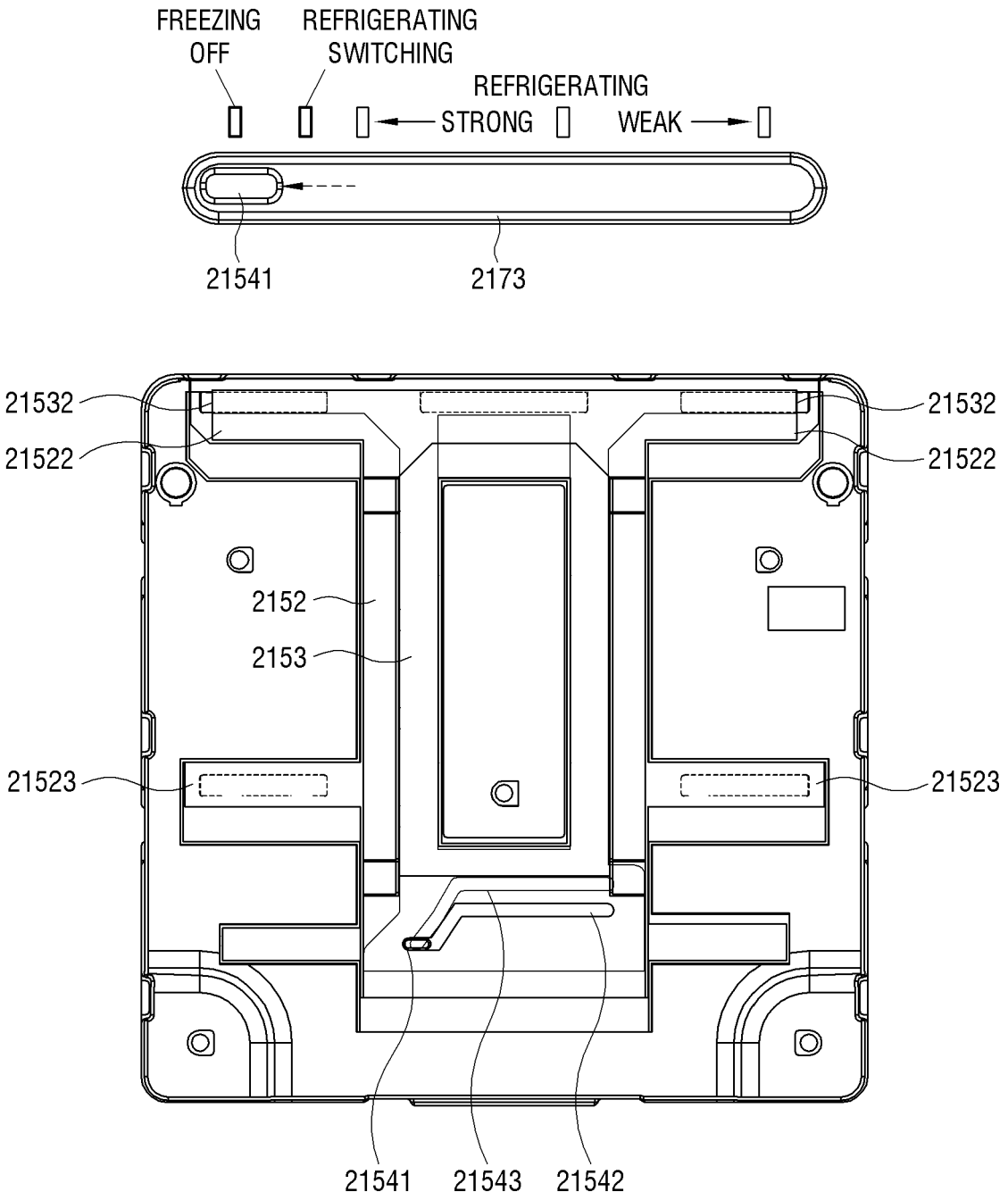
FIG. 23 illustrates an off mode for the freezer compartment.

FIG. 16 illustrates the manipulator 2154, FIG. 17 illustrates the first duct 21 viewed from the front, FIGS. 18 to 20 illustrate first to third cold-air adjusting modes for the refrigerator compartment 12, and FIGS. 21 to 23 illustrate a freezing mode, a refrigeration switching mode, and an off mode for the freezer compartment 11.

Referring to FIG. 16, the first and second guide slots 21542 and 21543 overlap with each other, and the knob 21541 is inserted in the overlapped first and second guide slots 21542 and 21543.

The manipulator 2154 including the knob 21541 and the first and second guide slots 21542 and 21543 may be controlled for the cold-air adjusting mode of the refrigerator compartment 12, the refrigeration switching mode of the freezer compartment 11, and the on/off mode of the freezer compartment 11.

The cold-air adjusting mode of the refrigerator compartment 12 may be performed when the knob 21541 moves within a refrigeration control range (i.e., a temperature control range of a refrigerator compartment) of the knob hole 2173. In other words, the cold-air adjusting mode of the refrigerator compartment 12 allows the knob 21541 to move within the overlapped first and third horizontal slots HS1 and HS3 in FIG. 16. In this case, the knob 21541 moves in the same direction as the elongating direction of the first and third horizontal slots HS1 and HS3, and thus does not affect the second and third shutters 2152 and 2153.

In FIG. 17, the cold-air adjusting mode of the refrigerator compartment 12 allows the amount of cold air passing through the connection channel 2111 to gradually increase as the knob 21541 moves from the right side (in a direction toward the fifth cold-air outlet 213-5) toward the left side (in a direction toward the fourth cold-air outlet 213-4) of the knob hole 2173.

FIGS. 18 to 20 are cross-sectional views of the first duct 21 cut open in the horizontal direction and viewed from above. Referring to FIG. 18, when the knob 21541 is positioned at the right end (i.e., the direction toward the fifth cold-air outlet 213-5 in FIG. 17) of the knob hole 2173 under the first cold-air adjusting mode of the refrigerator compartment 12, the refrigerator compartment 12 may operate in a weak refrigerating mode because only the sub cold-air through hole 21515 of the first shutter 2151 is positioned inside the connection channel 2111 and thus a very small amount of cold air flows in.

Referring to FIG. 19, when the knob 21541 is positioned at the middle of the refrigerator compartment cold-air adjustment range of the knob hole 2173 under the second cold-air adjusting mode of the refrigerator compartment 12, the refrigerator compartment 12 may operate in a normal refrigerating mode because the linearly extended portion 21516 of the main cold-air through hole 21514 of the first shutter 2151 and the sub cold-air through hole 21515 are positioned inside the connection channel 2111 and thus cold air more than that of the first cold-air adjusting mode flows in.

Referring to FIG. 20, when the knob 21541 is positioned at the refrigerating mode left end (i.e., the direction toward the fourth cold-air outlet 213-4 in FIG. 17) of the knob hole 2173 under the third cold-air adjusting mode of the refrigerator compartment 12, the refrigerator compartment 12 may operate in a strong refrigerating mode because the whole main cold-air through hole 21514 and the sub cold-air through hole 21515 of the first shutter 2151 are positioned inside the connection channel 2111 and thus the maximum amount of cold air flows in.

Referring to FIG. 21, the freezing mode of the freezer compartment 11 may be carried out when the knob 21541 is positioned within the refrigerator compartment cold-air adjustment range which does not affect the vertical movement of the second and third shutters 2152 and 2153, in other words, when the knob 21541 moves within the first and third horizontal slots HS1 and HS3. In this case, the first and second horizontal bars 21522 and 21523 of the second shutter 2152 and the third horizontal bar 21532 of the third shutter 2153 do not overlap with the first to fifth cold-air outlets 213-1~213-5, and therefore cold air is normally discharged to the freezer compartment 11, thereby allowing the freezer compartment 11 to implement the freezing function.

Referring to FIG. 22, the refrigeration switching mode of the freezer compartment 11 may be performed when the knob 21541 moves to a refrigeration switching position of the knob hole 2173 in FIG. 16. In other words, the refrigeration switching mode of the freezer compartment 11 allows the knob 21541 to be guided within the overlapped first and second inclined slots VS1 and VS2 in FIG. 16. In this case, the knob 21541 substantially horizontally moves to the refrigeration switching position of the knob hole 2173, but both the second and third shutters 2152 and 2153 are forcibly moved upward along the first and second inclined slots VS1 and VS2 inclined downward.

When the knob 21541 is in the refrigeration switching position of the knob hole 2173 under the refrigeration switching mode of the freezer compartment 11, the second shutter 2152 moves upward so that the first to third opening holes 2*a*~2*c* of the first horizontal bar 21522 can overlap with the first to third cold-air outlets 213-1~213-3 and the second horizontal bar 21523 can overlap with the fourth and fifth cold-air outlets 213-4 and 213-5. In result, the freezer compartment 11 implements the refrigerating function because the second horizontal bar 21523 shuts off cold air discharged through the fourth and fifth cold-air outlets 213-4 and 213-5, and a limited amount of cold air is supplied through the first to third opening holes 2*a*~2*c* of the first horizontal bar 21522.

Referring to FIG. 23, the off mode of the freezer compartment 11 may be performed when the knob 21541 moves to the off-mode position of the knob hole 2173 in FIG. 16. In other words, the off mode of the freezer compartment 11 allows the knob 21541 to move within the second horizontal slot HS2 and the third inclined slot VS3 overlapped in FIG. 16. In this case, when the knob 21541 horizontally moves to the off-mode position of the knob hole 2173, the second shutter 2152 moves within the second horizontal slot HS2 in the same direction as the knob hole 2173 without interruption and the third shutter 2153 is forcibly moved upward along the third inclined slot VS3 in an inclined direction different from the horizontal moving direction of the knob hole 2173.

In this way, when the knob 21541 is in the off-mode position of the knob hole 2173 under the off mode of the freezer compartment 11, the third shutter 2153 is moved upward so that the third horizontal bar 21532 can overlap with the first to third cold-air outlets 213-1~213-3. In result, the freezer compartment 11 may be off because the third horizontal bar 21532 blocks up the first to third cold-air outlets 213-1~213-3 and shuts off supplied cold air.

Below, a first duct 51 according to another embodiment of the disclosure will be described with reference to FIGS. 24 to 29.

Figure 24:
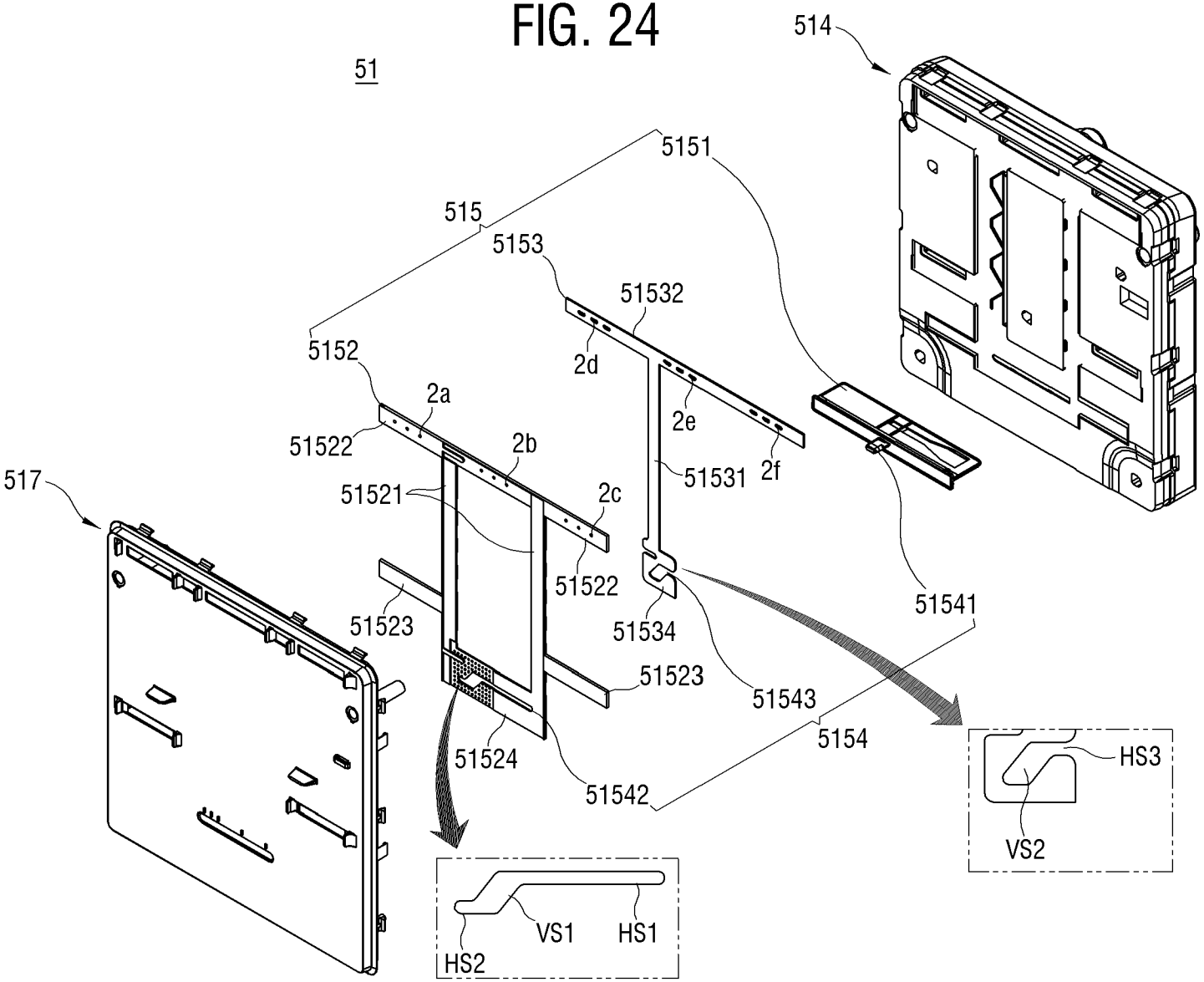
FIG. 24 is an exploded perspective view of a first duct according to another embodiment of the disclosure.

FIG. 24 is an exploded perspective view of the first duct 51 according to another embodiment of the disclosure.

As shown in FIG. 24, the first duct 51 may include a channel former 514, a cold-air adjuster 515 for adjusting the amount of cold air supplied to the freezer compartment 11 and the refrigerator compartment 12, and a mounting cover 517 for mounting the cold-air adjuster 515 to the channel former 514. The channel former 514 and the mounting cover 517 are similar to the channel former 214 and the mounting cover 217 shown in FIGS. 11 and 12, and thus repetitive descriptions thereof will be avoided.

Referring to FIG. 24, the cold-air adjuster 515 may include a first shutter 5151 provided in a channel for carrying cold air to the refrigerator compartment 12, second and third shutters 5152 and 5153 mounted to the channel former 514, and a manipulator 5154 provided in the first to third shutters 5151~5153.

The first shutter 5151 moves in the horizontal direction to adjust the cross-sectional area of the connection channel through which cold air is supplied to the refrigerator compartment 12. The first shutter 5151 is similar to the first shutter 2151 shown in FIG. 13, and thus repetitive descriptions will be avoided.

The second shutter 5152 moves in the vertical direction to adjust the effective sizes of the first to fifth cold-air outlets 213-1~213-5 for discharging cold air to the freezer compartment 11.

Referring to FIG. 24, the second shutter 5152 includes a pair of columns 51521 shaped like plates spaced apart from each other and extended in the first direction, a first horizontal bar 51522 extended from the first ends of the pair of columns 51521 in the second direction perpendicular to the first direction, a second horizontal bar 51523 extended from the second ends of the pair of columns 51521 in the second direction, and a first slot former 51524 into which second ends of the pair of columns 21521 are integrated and which is extended in a direction opposite to the first direction. The first slot former 51524 includes a first guide slot 51542.

The first horizontal bar 51522 may include the first to third opening holes 2*a*~2*c* smaller than the first to third cold-air outlets 213-1~213-3. The first to third opening holes 2*a*~2*c* may be embodied by a plurality of opening holes or a single opening hole. The first to third opening holes 2*a*~2*c* overlap with the first to third cold-air outlets 213-1~213-3 when the second shutter 5152 moves in the first direction, thereby decreasing the amount of cold air discharged through the first to third cold-air outlets 213-1~213-3.

The second horizontal bar 51523 is shaped like a plate and overlaps with the fourth and fifth cold-air outlets 213-4~213-5 when the second shutter 5152 moves in the first direction, thereby shutting off cold air discharged through the fourth and fifth cold-air outlets 213-4~213-5.

According to an alternative embodiment, the second horizontal bar 51523 may include an opening hole smaller than the fourth and fifth cold-air outlets 213-4 and 213-5 like the first horizontal bar 51522. In this case, the second horizontal bar 51523 may decrease the amount of discharged cold air without completely blocking up the fourth and fifth cold-air outlets 213-4~213-5 when the second shutter 5152 moves up.

The third shutter 5153 may move to open or block the first to third cold-air outlets 213-1~213-3 through which cold air is discharged to the freezer compartment 11.

Referring to FIG. 24, the third shutter 5153 includes one column 51531 shaped like a plate and extended in the first direction, a third horizontal bar 51532 extended from the first end of the column 51531 and extended in the second direction perpendicular to the first direction, and a second slot former 51534 into which the lower end of the column 51531 is integrated and which is extended in a direction opposite to the first direction. The second slot former 51534 may include a second guide slot 51543.

The third horizontal bar 51532 may be shaped like a plate and include the fourth to the sixth opening holes 2*d*~2*f* larger than the first to third opening holes 2*a*~2*c* of the first horizontal bar 51522. The fourth to the sixth opening holes 2*d*~2*f* overlap and communicate with the first to third opening holes 2*a*~2*c* formed in the first horizontal bar 51522 of the second shutter 5152 when the second and third shutters 5152 and 5153 move together. Then, when the third shutter 5153 solely moves in a horizontal direction, the first to third opening holes 2*a*~2*c* are misaligned with and do not communicate with the fourth to the sixth opening holes 2*d*~2*f*, thereby shutting off cold air supplied to the freezer compartment 11 and making the freezer compartment 11 enter the off mode.

According to an alternative embodiment, the third shutter 5153 may further include an additional horizontal bar corresponding to the second horizontal bar 51523 of the second shutter 5152. In this case, when a small opening hole is formed in the second horizontal bar 51523 of the second shutter 5152, the additional horizontal bar may block up this small opening hole.

The manipulator 5154 may, as shown in FIG. 24, include a knob 51541 provided in the first shutter 5151, a first guide slot 51542 formed in the second shutter 5152, and the second guide slot 51543 formed in the third shutter 5153.

The knob 51541 may, as shown in FIG. 24, protrude in as direction perpendicular to the surface of a front frame 51511 of the first shutter 5151. The knob 51541 protruding in this way may be exposed to the inside of the freezer compartment 11 and manipulated by a user.

The first guide slot 51542 may, as shown in FIG. 24, include a first horizontal slot HS1 elongated on the first slot former 51524 in a first horizontal direction, a first inclined slot VS1 integrally elongated from a first end of the first horizontal slot HS1 in a first inclined direction, and a second horizontal slot HS2 integrally elongated from a first end of the first inclined slot VS1 in a second horizontal direction.

The second guide slot 51543 may, as shown in FIG. 24, include a third horizontal slot HS3 elongated on the second slot former 51534 in the first horizontal direction, and a second inclined slot VS2 integrally elongated from a first end of the third horizontal slot HS3 in the second inclined direction. The third horizontal slot HS3 is short to overlap with a first-horizontal direction end of the first horizontal slot HS1 of the first guide slot 51542, and the second inclined slot VS2 has the same length as the first inclined slot VS1. Of course, the third horizontal slot HS3 may be long to correspond to the entire first horizontal slot HS1 of the first guide slot 51542.

Below, the operations of the cold-air adjuster 515 will be described with reference to FIGS. 25 to 29.

Figure 25:
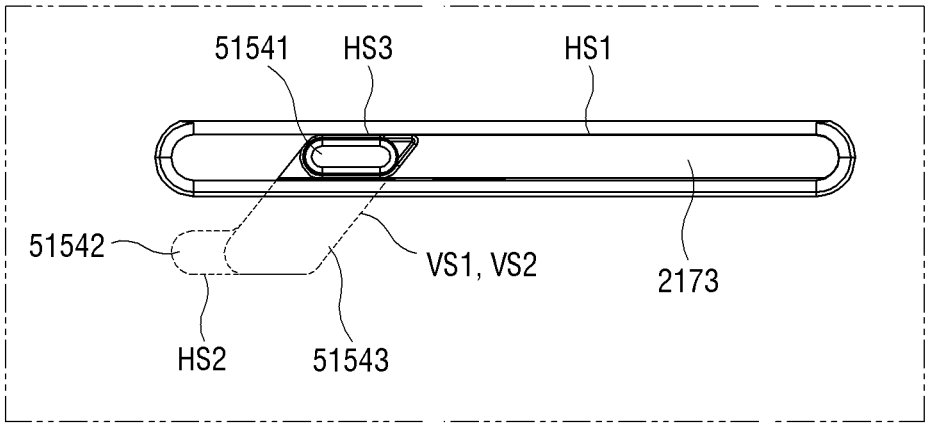
FIG. 25 illustrates a manipulator of FIG. 24.
Figure 26:
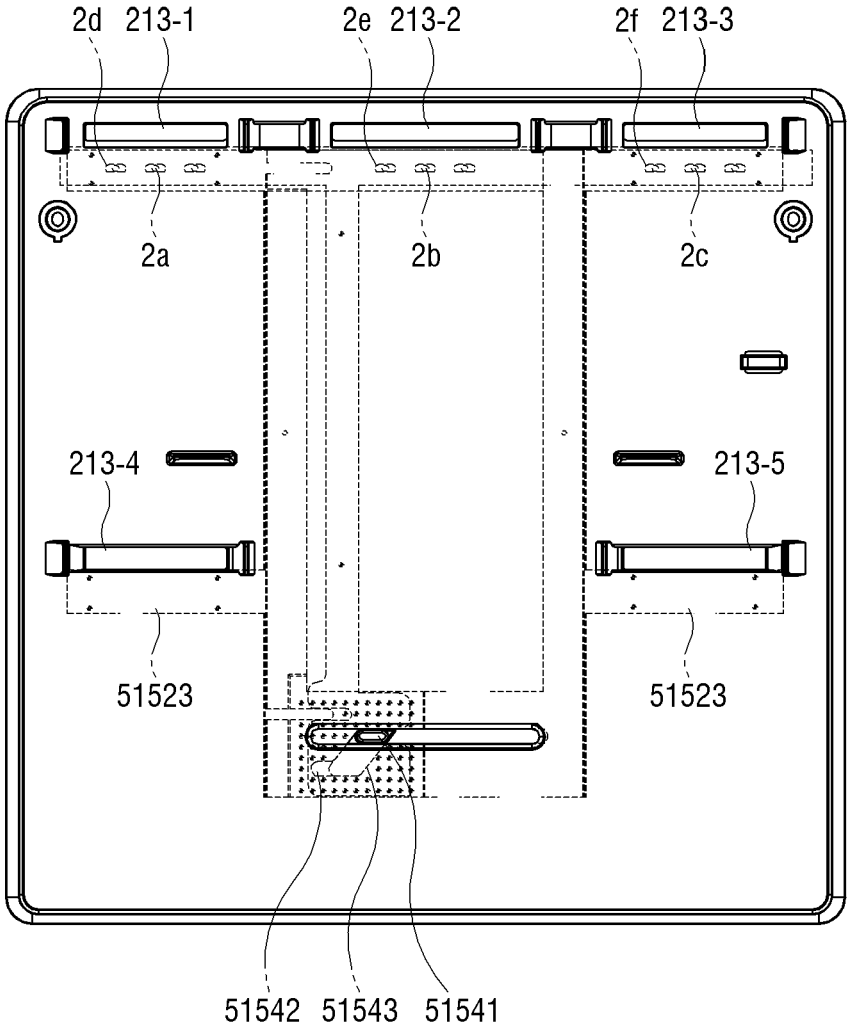
FIG. 26 illustrates the first duct of FIG. 24 viewed from the front.
Figure 27:
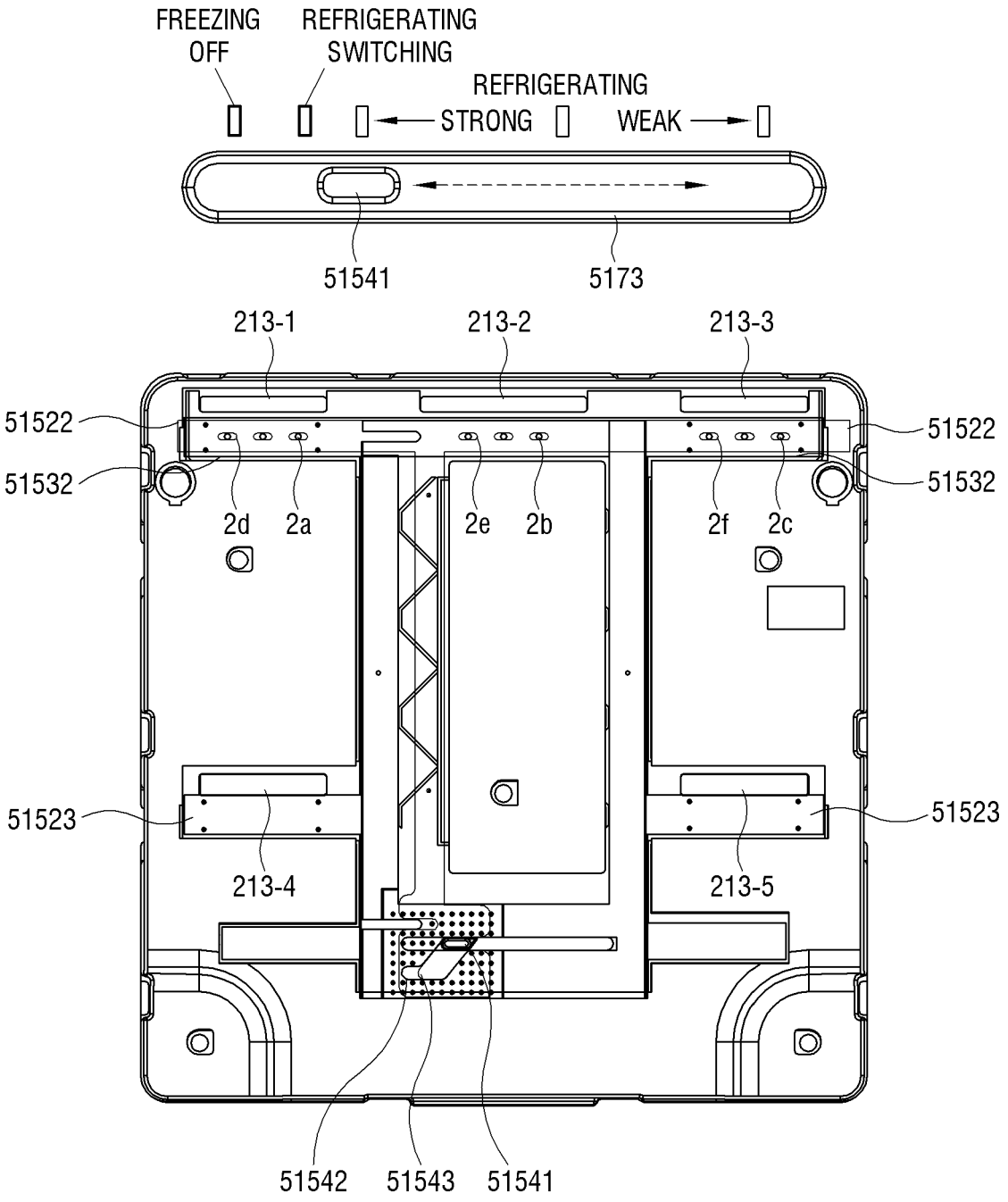
FIG. 27 illustrates a freezing mode for a freezer compartment of FIG. 26.
Figure 28:
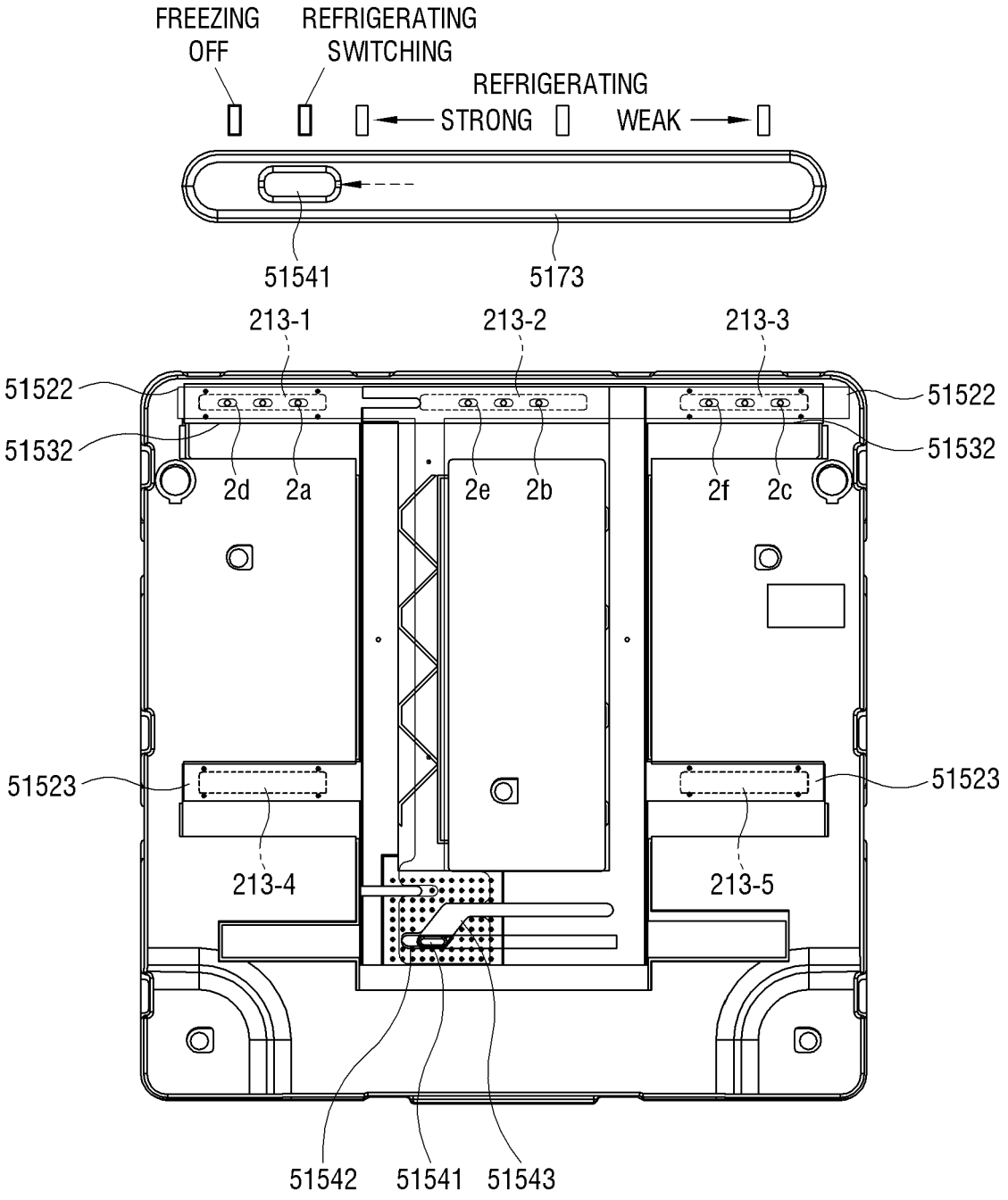
FIG. 28 illustrates a refrigeration switching mode for the freezer compartment of FIG. 26.
Figure 29:
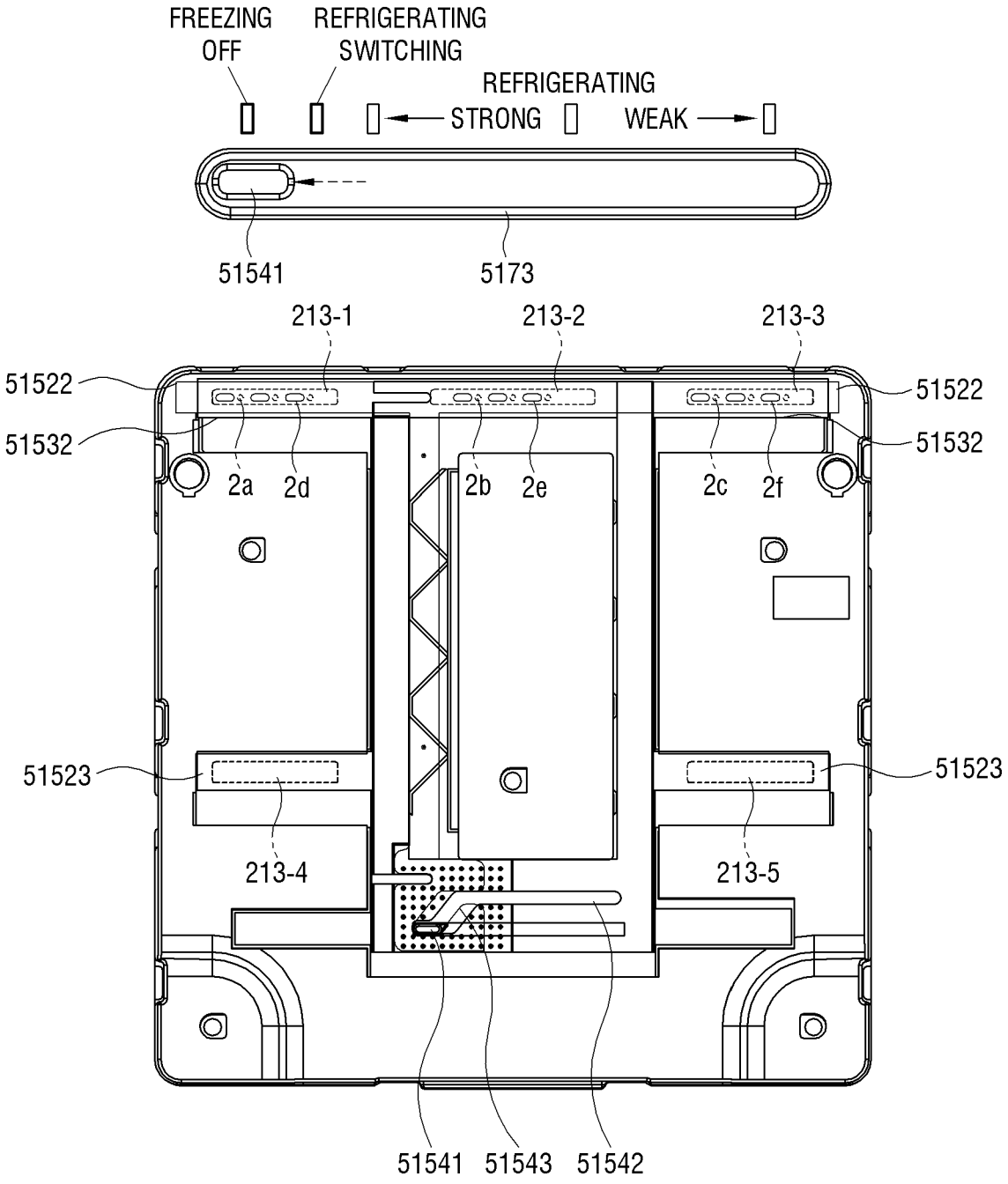
FIG. 29 illustrates an off mode for the freezer compartment of FIG. 26

FIG. 25 illustrates the manipulator 5154, FIG. 26 illustrates the first duct 51 viewed from the front, and FIGS. 27 to 29 illustrate the freezing mode, the refrigeration switching mode and the off mode for the freezer compartment 11.

Referring to FIGS. 25 and 26, the first and second guide slots 51542 and 51543 overlap with each other, and the knob 51541 is inserted in the overlapped first and second guide slots 51542 and 51543.

The manipulator 5154 including the knob 51541 and the first and second guide slots 51542 and 51543 may be controlled for the cold-air adjusting mode of the refrigerator compartment 12, the refrigeration switching mode of the freezer compartment 11, and the off mode of the freezer compartment 11.

The cold-air adjusting mode of the refrigerator compartment 12 may allow the amount of cold air passing through the connection channel to gradually increase as the knob 51541 moves from the right side (in a direction toward the fifth cold-air outlet 213-5) toward the left side (in a direction toward the fourth cold-air outlet 213-4) of the knob hole 2173. The cold-air adjusting mode of the refrigerator compartment 12 is similar to that shown in FIGS. 18 to 19, and thus repetitive descriptions thereof will be avoided.

Referring to FIG. 27, the freezing mode of the freezer compartment 11 may be carried out when the knob 51541 is positioned within the cold-air adjustment range of refrigerator compartment 12, in other words, when the knob 51541 moves within the first and third horizontal slots HS1 and HS3, without affecting the vertical movement of the second and third shutters 5152 and 5153. In this case, the first and second horizontal bars 51522 and 51523 of the second shutter 5152 and the third horizontal bar 51532 of the third shutter 5153 do not overlap with the first to fifth cold-air outlets 213-1~213-5, and therefore cold air is normally discharged to the freezer compartment 11, thereby allowing the freezer compartment 11 to implement the freezing function.

Referring to FIG. 28, the refrigeration switching mode of the freezer compartment 11 may be performed when the knob 51541 moves to a refrigeration switching position of the knob hole 2173 in FIG. 25. In other words, the refrigeration switching mode of the freezer compartment 11 allows the knob 51541 to be guided within the overlapped first and second inclined slots VS1 and VS2 in FIG. 25. In this case, the knob 51541 substantially horizontally moves to the refrigeration switching position of the knob hole 2173, but both the second and third shutters 2152 and 2153 are forcibly moved upward along the first and second inclined slots VS1 and VS2 which are inclined downward.

The refrigeration switching mode of the freezer compartment 11 may be performed when the knob 51541 is moved to the refrigeration switching position of the knob hole 2173. The second and third shutters 5152 and 5153 move upward, so that the first to third opening holes 2*a*~2*c* of the first horizontal bar 51522 and the fourth to the sixth opening holes 2*d*~2*f* of the third horizontal bar 5532 can overlap to communicate with the first to third cold-air outlets 213-1~213-3, thereby allowing the second horizontal bar 51523 to overlap with the fourth and fifth cold-air outlets 213-4 and 213-5. In result, the freezer compartment 11 implements the refrigerating function because the second horizontal bar 51523 shuts off cold air discharged through the fourth and fifth cold-air outlets 213-4 and 213-5, and a small amount of cold air is supplied through the smallest first to third opening holes 2*a*~2*c* of the first horizontal bar 51522.

Referring to FIG. 29, the off mode of the freezer compartment 11 may be performed when the knob 51541 moves to the off-mode position of the knob hole 2173 in FIG. 25. In other words, the off mode of the freezer compartment 11 allows the knob 51541 to move within the second horizontal slot HS2 of FIG. 25. When the knob 51541 horizontally moves to the off-mode position of the knob hole 2173, the second shutter 5152 is moved within the second horizontal slot HS2 in the same direction as the knob hole 2173 without interruption, and the third shutter 5153 itself is moved by the knob 51541 because there are no slots for moving the third shutter 5153. In result, the first to third opening holes 2*a*~2*c* are misaligned with and do not communicate with the fourth to the sixth opening holes 2*d*~2*f*, thereby shutting off cold air supplied to the freezer compartment 11 and making the freezer compartment 11 enter the off mode.

Below, a first duct 61 according to still another embodiment of the disclosure will be described with reference to FIGS. 30 to 35.

Figure 30:
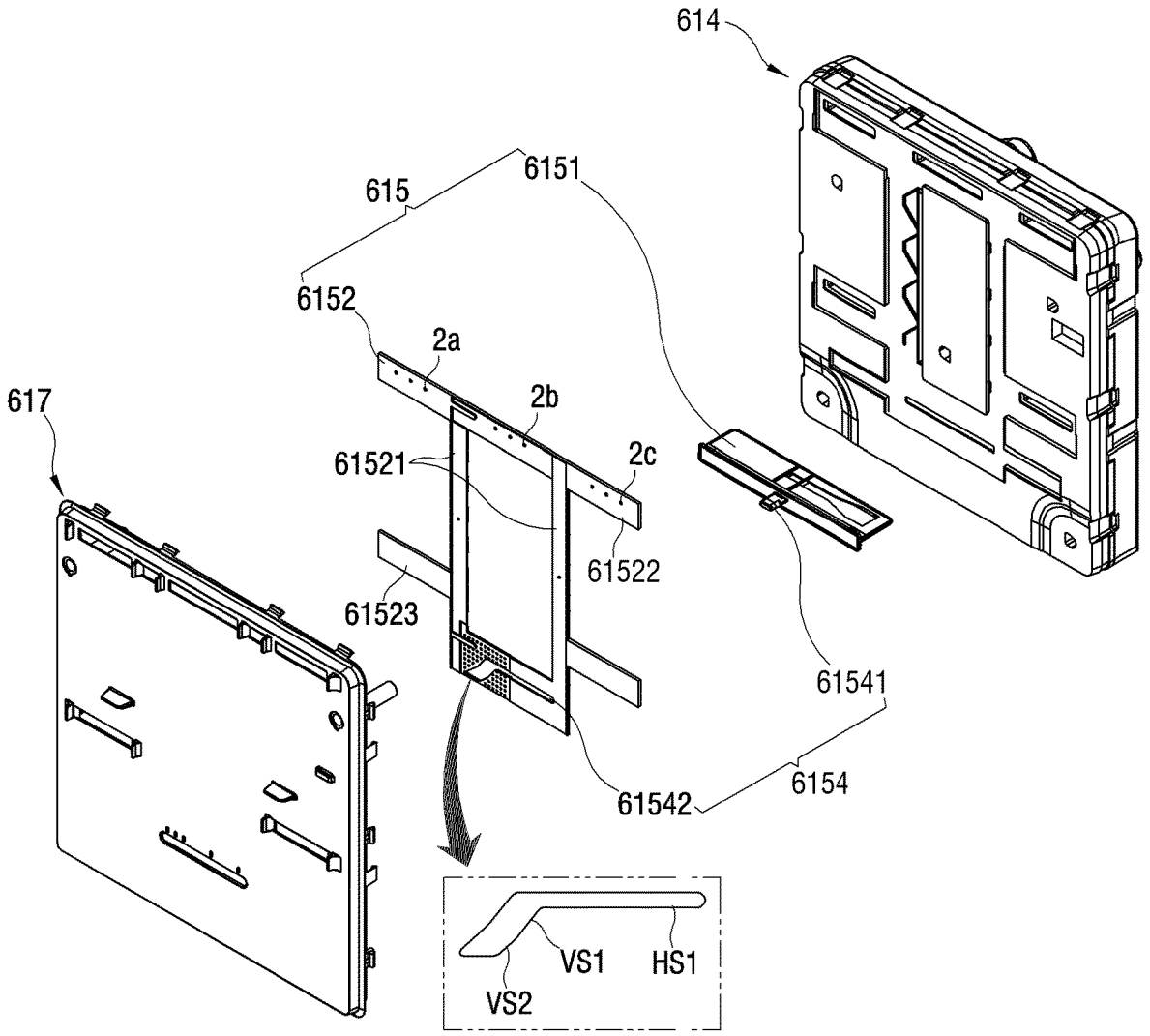
FIG. 30 is an exploded perspective view of a first duct according to still another embodiment of the disclosure.

FIG. 30 is an exploded perspective view of the first duct 61 according to still another embodiment of the disclosure.

As shown in FIG. 30, the first duct 61 may include a channel former 614, a cold-air adjuster 615 for adjusting the amount of cold air supplied to the freezer compartment 11 and the refrigerator compartment 12, and a mounting cover 617 for mounting the cold-air adjuster 615 to the channel former 614. The channel former 614 and the mounting cover 617 are similar to the channel former 214 and the mounting cover 217 shown in FIGS. 11 and 12, and therefore repetitive descriptions will be avoided.

Referring to FIG. 30, the cold-air adjuster 615 may include a first shutter 6151 provided in a channel for carrying cold air to the refrigerator compartment 12, a second shutter 6152 provided in a shutter guide 61427, and a manipulator 6154 provided in the first and second shutters 6151 and 6152.

The first shutter 6151 moves in a horizontal direction to adjust the cross-sectional area of the channel for supplying cold air to the refrigerator compartment 12. The first shutter 6151 is similar to the first shutter 2151 shown in FIG. 13, and thus repetitive descriptions thereof will be avoided.

The second shutter 6152 moves in a vertical direction to adjust the effective size of the first to fifth cold-air outlets 213-1~213-5 from which cold air is discharged to the freezer compartment 11.

Referring to FIG. 30, the second shutter 6152 includes a pair of columns 61521 shaped like plates spaced apart from each other and extended in a first direction, a first horizontal bar 61522 extended from the first ends of the pair of columns 61521 in a second direction perpendicular to the first direction, a second horizontal bar 61523 extended from the second ends of the pair of columns 61521 in the second direction, and a first slot former 61524 into which the second ends of the pair of columns 61521 are integrated and which is extended in a direction opposite to the first direction. The first slot former 61524 may include the first guide slot 61542.

The first horizontal bar 61522 may include the first to third opening holes 2*a*~2*c* smaller than the first to third cold-air outlets 213-1~213-3 in an upper portion thereof. The first to third opening holes 2*a*~2*c* may be embodied by a plurality of opening holes or a single opening hole. The first to third opening holes 2*a*~2*c* overlap with the first to third cold-air outlets 213-1~213-3 when the second shutter 6152 is moved in a first step in the first direction, thereby decreasing the amount of cold air discharged through the first to third cold-air outlets 213-1~213-3.

When the second shutter 6152 is moved in a second step in the first direction, the first horizontal bar 61522 formed with no first to third opening holes 2*a*~2*c* overlaps with the first to third cold-air outlets 213-1~213-3. In result, the freezer compartment 11 enters the off mode because cold air discharged through the first to third cold-air outlets 213-1~213-3 is shut off.

The second horizontal bar 61523 shaped like a plate and formed with no opening holes overlaps with the fourth and fifth cold-air outlets 213-4~213-5 when the second shutter 6152 is moved in the first and second steps, thereby shutting off cold air discharged through the fourth and fifth cold-air outlets 213-4~213-5.

According to an alternative embodiment, the second horizontal bar 61523 may include opening holes smaller than the fourth and fifth cold-air outlets 213-4~213-5 like the first horizontal bar 61522. In this case, the second horizontal bar 61523 may not completely block up the fourth and fifth cold-air outlets 213-4~213-5 when the second shutter 6152 is moved in the first step in the first direction, thereby reducing the amount of discharged cold air.

The manipulator 6154 may, as shown in FIG. 30, include a knob 61541 provided in the first shutter 6151, and a first guide slot 61542 provided in the second shutter 6152.

The knob 61541 protrudes in a direction perpendicular to a front frame 61511 of the first shutter 6151 as shown in FIG. 30. The knob 61541 protruding in this way is exposed to the inside of the freezer compartment 11 and manipulated by a user.

The first guide slot 61542 may, as shown in FIG. 30, include a first horizontal slot HS1 elongated on the first slot former 61524 in the first horizontal direction, and a first inclined slot VS1 integrally elongated from a first end of the first horizontal slot HS1 in the first inclined direction.

Within the first inclined slot VS1, the knob 61541 may be guided as divided into the first step and the second step. The freezer compartment 11 enters the refrigeration switching mode when the knob 61541 is guided up to the first step, and enters the off mode when the knob 61541 is guided up to the second step.

Below, the operations of the cold-air adjuster 615 will be described with reference to FIGS. 31 to 35.

Figure 31:
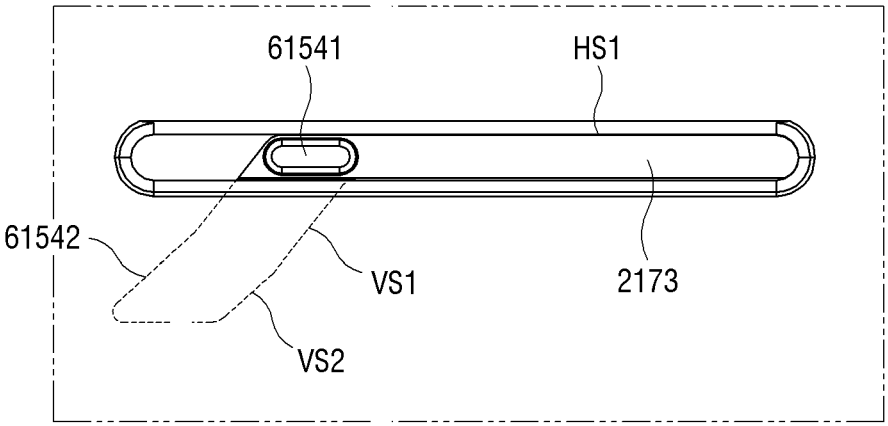
FIG. 31 illustrates a manipulator of FIG. 30.
Figure 32:
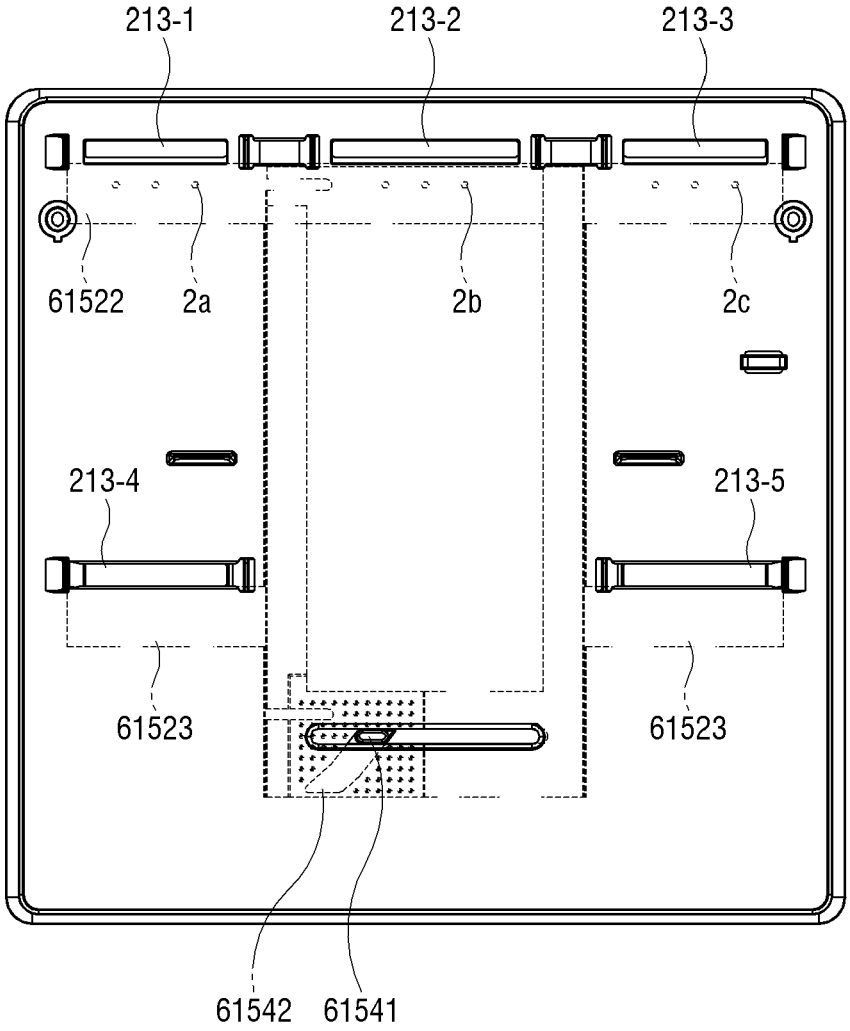
FIG. 32 illustrates the first duct of FIG. 30 viewed from the front.
Figure 33:
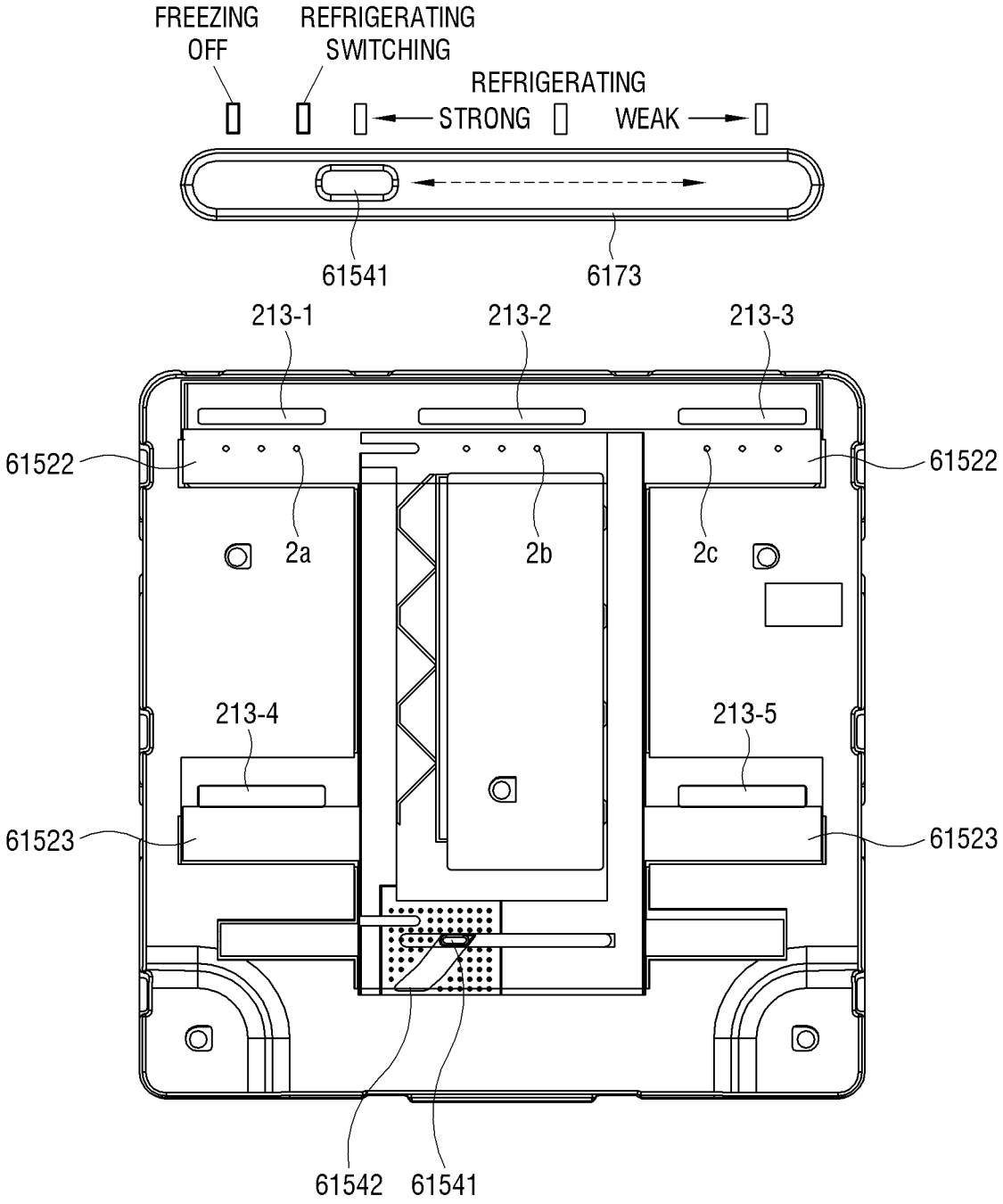
FIG. 33 illustrates a freezing mode for a freezer compartment of FIG. 32.
Figure 34:
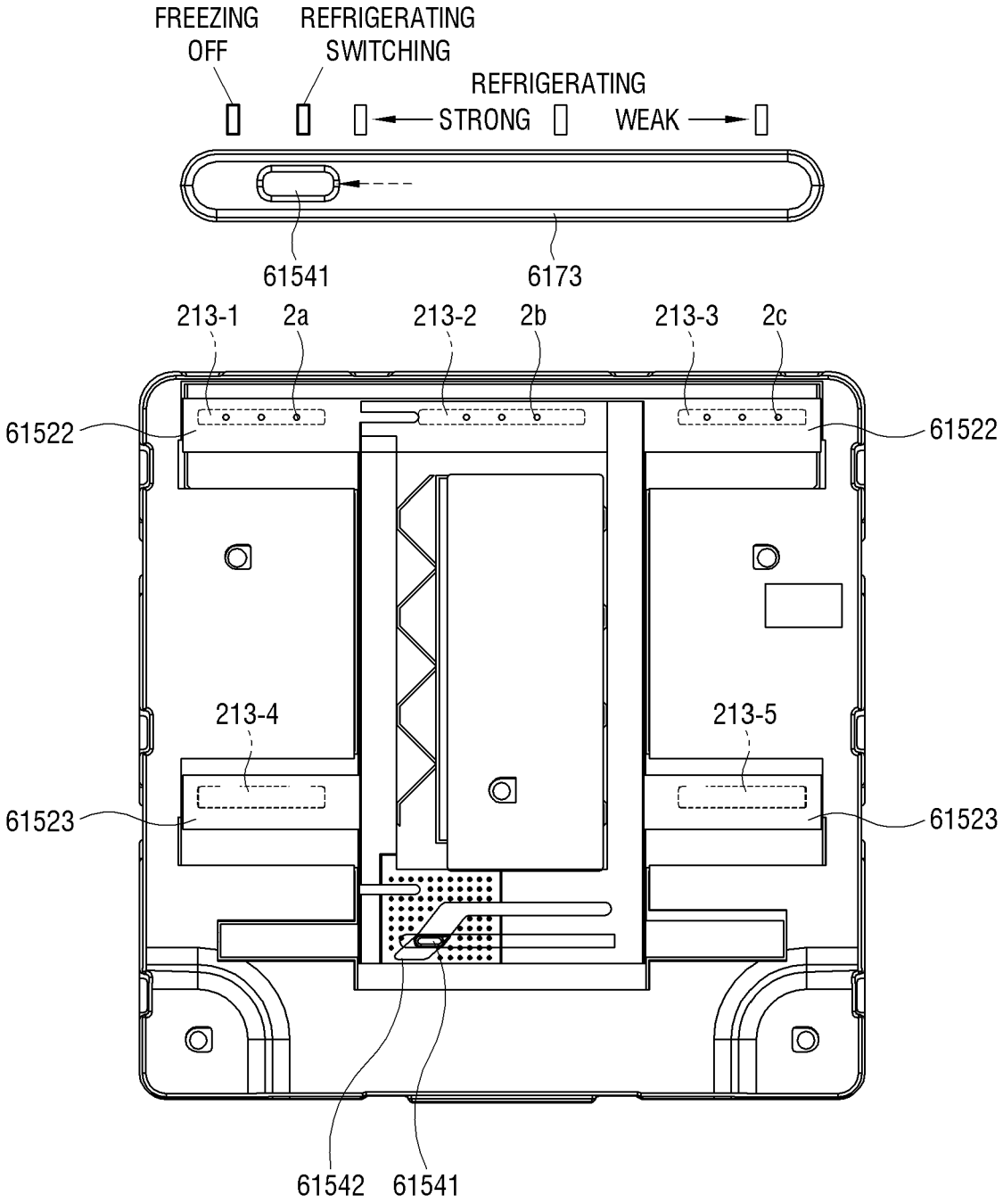
FIG. 34 illustrates a refrigeration switching mode for the freezer compartment of FIG. 32.
Figure 35:
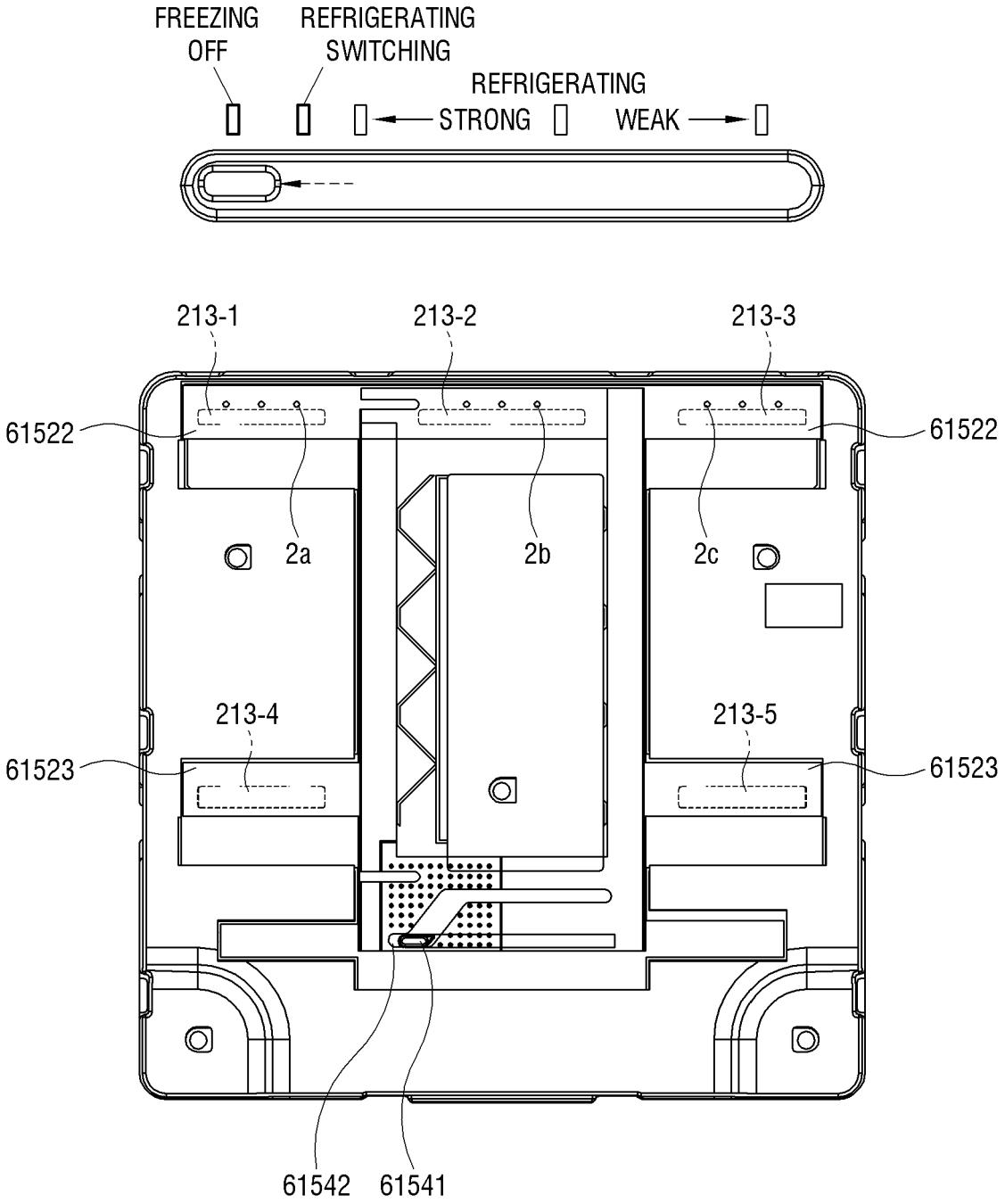
FIG. 35 illustrates an off mode for the freezer compartment of FIG. 32.

FIG. 31 illustrates the manipulator 6154, FIG. 32 illustrates the first duct 61 viewed from the front, and FIGS. 33 to 35 illustrate the freezing mode, the refrigeration switching mode and the off mode for the freezer compartment 11.

Referring to FIGS. 31 and 32, the knob 61541 may be inserted in the first guide slot 61542.

The manipulator 6154 may be controlled for the cold-air adjusting mode of the refrigerator compartment 12, the refrigeration switching mode of the freezer compartment 11, and the off mode of the freezer compartment 11.

The cold-air adjusting mode of the refrigerator compartment 12 allow the amount of cold air passing through the connection channel to gradually increase as the knob 61541 moves from the right side (in a direction toward the fifth cold-air outlet 213-5) toward the left side (in a direction toward the fourth cold-air outlet 213-4) of the knob hole 2173. The cold-air adjusting mode of the refrigerator compartment 12 is similar to that shown in FIGS. 18 to 19, and thus repetitive descriptions thereof will be avoided.

Referring to FIG. 33, the freezing mode of the freezer compartment 11 may be carried out when the knob 61541 is positioned within the cold-air adjustment range of refrigerator compartment 12, in other words, when the knob 61541 moves within the first and third horizontal slots HS1 and HS3, without affecting the vertical movement of the second shutter 6152. In this case, the first and second horizontal bars 61522 and 61523 of the second shutter 6152 do not overlap with the first to fifth cold-air outlets 213-1~213-5, and therefore cold air is normally discharged to the freezer compartment 11, thereby allowing the freezer compartment 11 to implement the freezing function.

Referring to FIG. 34, the refrigeration switching mode of the freezer compartment 11 may be performed when the knob 61541 moves to a refrigeration switching position of the knob hole 6173 in FIG. 31. In other words, for the refrigeration switching mode of the freezer compartment 11, the knob 61541 is moved by the first step in the first inclined slot VS1 in FIG. 31. In this case, the knob 61541 substantially horizontally moves to the refrigeration switching position of the knob hole 2173, but the second shutter 6152 is forcibly moved upward in the first step by the first inclined slot VS1 inclined downward.

In the refrigeration switching mode of the freezer compartment 11, when the knob 61541 moves to the refrigeration switching position of the knob hole 2173, the second shutter 6152 is moved in the first direction so that the first to third opening holes 2*a*~2*c* of the first horizontal bar 61522 overlap and communicate with the first to third cold-air outlets 213-1~213-3, thereby allowing the second horizontal bar 61523 to overlap with the fourth and fifth cold-air outlets 213-4 and 213-5. In result, the second horizontal bar 61523 shuts off cold air discharged through the fourth and fifth cold-air outlets 213-4 and 213-5, so that a limited amount of cold air can be supplied through the first to third opening holes 2*a*~2*c* of the first horizontal bar 61522 smaller than the first to third cold-air outlets 213-1~213-3, thereby making the freezer compartment 11 switch over to the refrigerating function.

Referring to FIG. 35, the off mode of the freezer compartment 11 may be performed when the knob 61541 moves to the off-mode position of the knob hole 2173 in FIG. 31. In other words, for the off mode of the freezer compartment 11, the knob 61541 is guided in the second step of the first inclined slot VS1 in FIG. 31. In this case, when the knob 61541 horizontally moves to the off-mode position of the knob hole 2173, the knob 61541 substantially horizontally moves to the refrigeration switching position of the knob hole 2173 but the second shutter 6152 is additionally moved in the second step forcibly by the first inclined slot VS1.

The off mode of the freezer compartment 11 is performed when the knob 61541 moves to the off-mode position of the knob hole 2173. When the second shutter 6152 is moved in the first direction, the first horizontal bar 61522 blocks up the first to third cold-air outlets 213-1~213-3, and the second horizontal bar 61523 blocks up the fourth and fifth cold-air outlets 213-4 and 213-5. In result, the freezer compartment 11 enters the off mode as cold air flowing in through the first to fifth cold-air outlets 213-1~213-5 is shut off.

Figure 36:
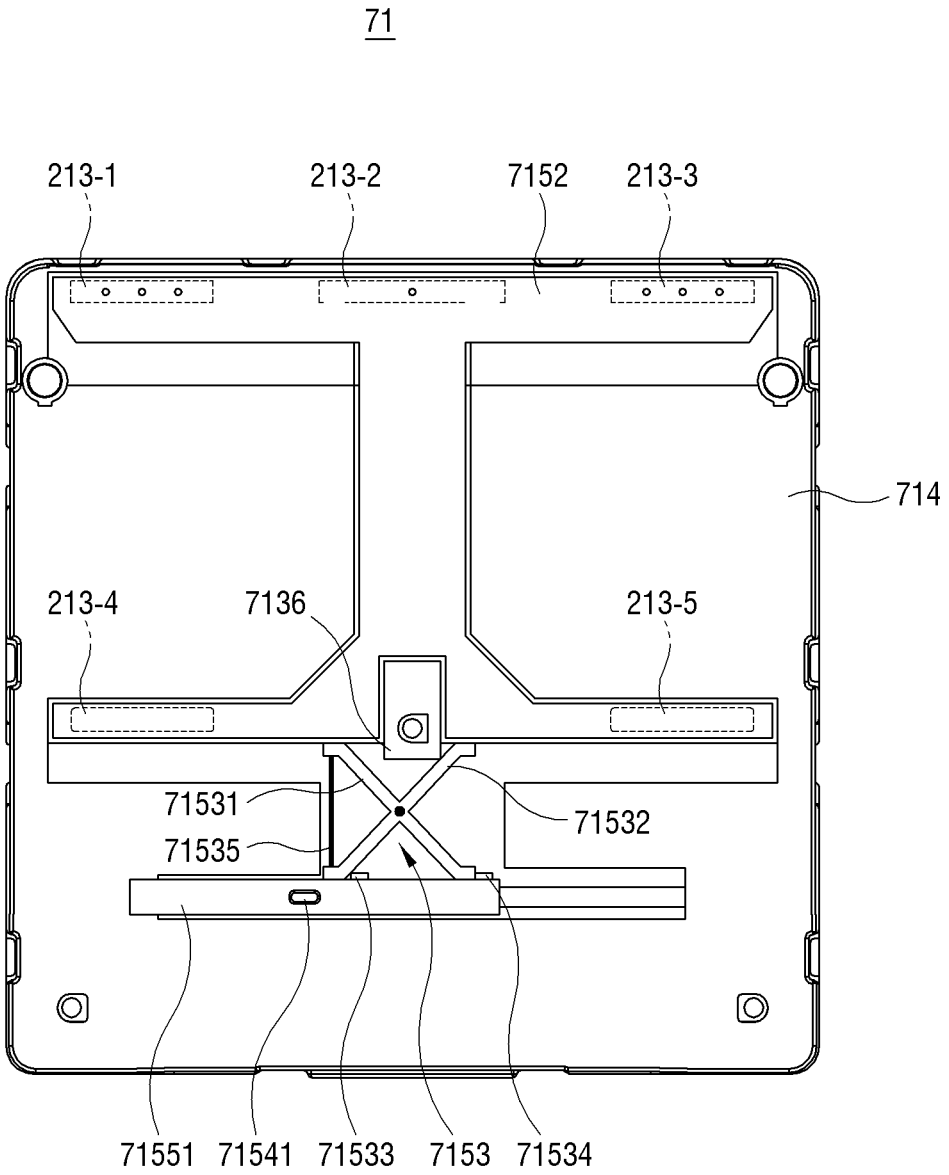
FIG. 36 illustrates an X-link structure by which the first shutter and the second shutter are interlocked.

FIG. 36 illustrates a structure of an X-link 7153 by which a first shutter 7151 and a second shutter 7152 are interlocked.

Referring to FIG. 36, the X-link 7153 is provided between the first shutter 7151 and the second shutter 7152.

The X-link 7153 includes a pair of bars 71531 and 71532 coupled crossing in an 'X' shape. Both ends of the pair of bars 71531 and 71532 at the left side are supported by a tension spring 71535. The first shutter 7151 is provided with a pair of projections 71533 and 71534 spaced apart thereon to hold two lower ends of the X-link 7153. The second shutter 7152 is provided with a movable projection 7136 protruding to be accommodated in a space above a cross point of the X-link 7153.

When a knob 71541 is moved leftward, the first shutter 7151 horizontally moves leftward. In this case, the right-side projection 71534 pushes a right-side lower portion of the X-link 7153 leftward to be horizontally moved. In this case, a left-side upper portion of the X-link 7153 pushes up the lower end of the second shutter 7152, and an incline in the space above the cross point of the X-link 7153 also pushes up the movable projection 7136. In result, the second shutter 7152 is moved up or down to adjust the sizes of the first to fifth cold-air outlets 213-1~213-5. The tension spring 71535 urges the X-link 7153 to keep its original shape when the first shutter 7151 returns rightward.

Figure 37:
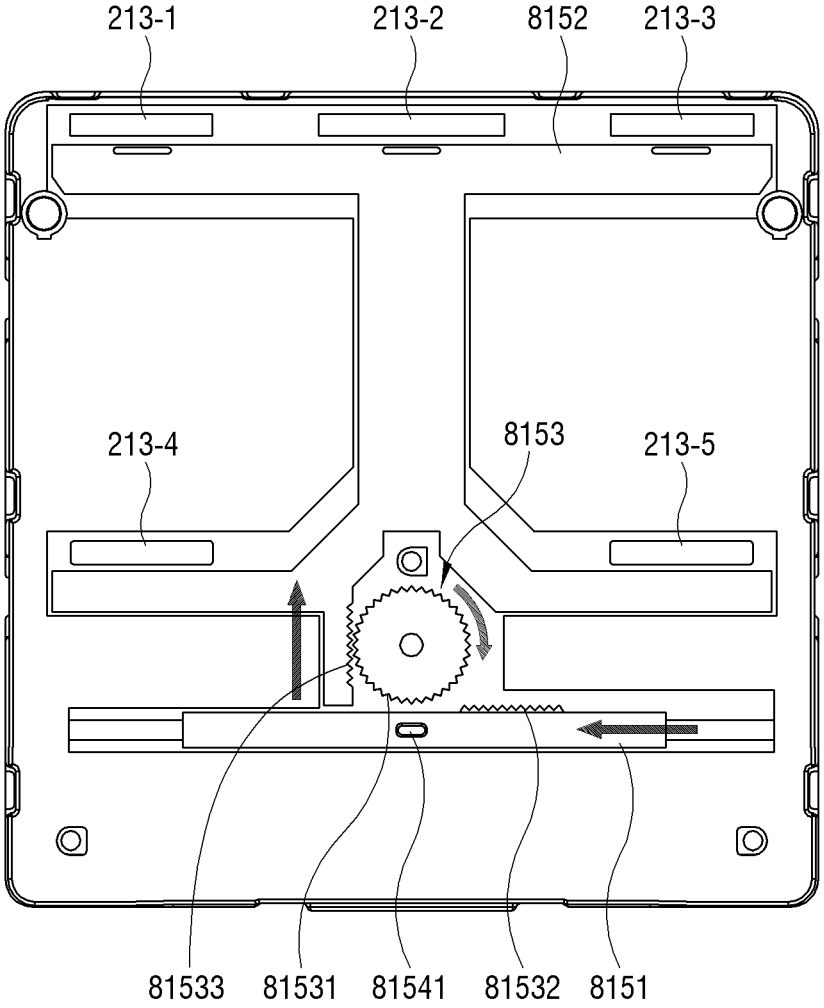
FIG. 37 illustrates a rack-and-pinion structure by which the first shutter and the second shutter are interlocked.

FIG. 37 illustrates a rack-and-pinion structure 8153 by which the first shutter 8151 and the second shutter 8152 are interlocked.

Referring to FIG. 37, the rack-and-pinion 8153 is provided between the first shutter 8151 and the second shutter 8152.

The rack-and-pinion 8153 includes a circular gear 81531, a first linear gear 81532 provided in the first shutter 8151 in a horizontal direction, and a second linear gear 81533 provided in the second shutter 8152 in a vertical direction. The first and second linear gears 81532 and 81533 engage with the circular gear 81531.

When a knob 81541 moves leftward, the first shutter 8151 horizontally moves leftward. In this case, the first linear gear 81532 makes the circular gear 81531 spin, and the spinning circular gear 81531 moves the second linear gear 81533 upward. In result, the second shutter 8152 moves up or down to adjust the sizes of the first to fifth cold-air outlets 213-1~213-5. The second shutter 8152 may move down as the rack-and-pinion 8153 operates in reverse order.

Figure 38:
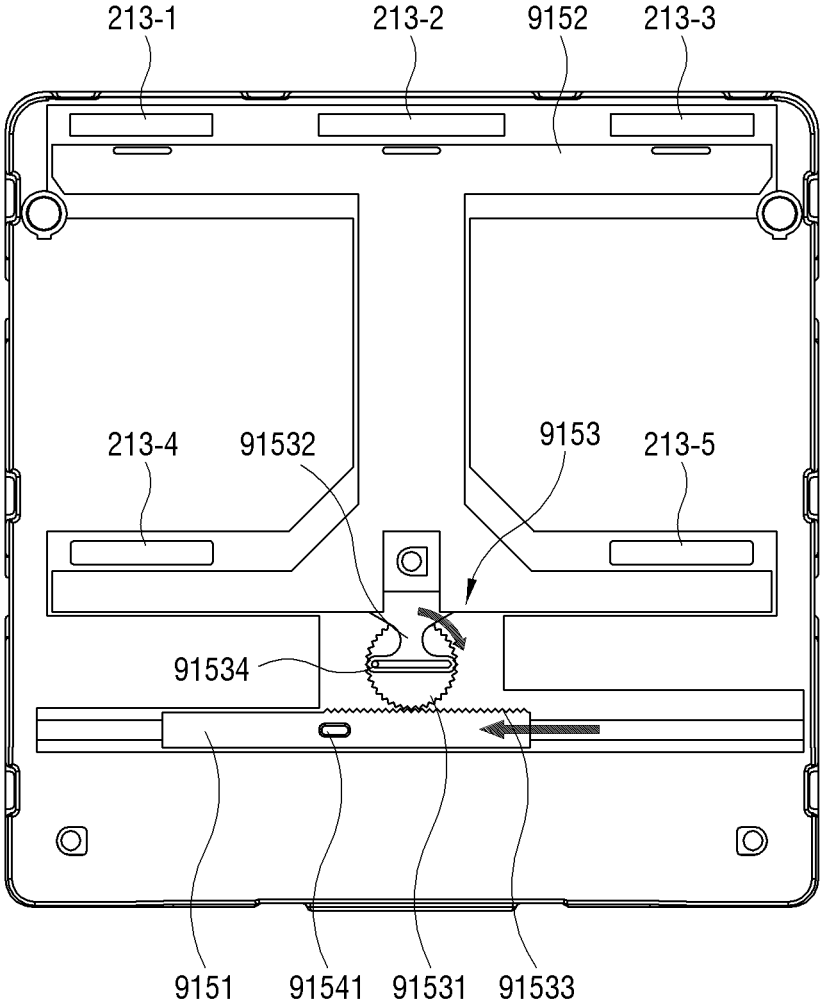
FIG. 38 illustrates a crank structure by which the first shutter and the second shutter are interlocked.

FIG. 38 illustrates a crank structure by which a first shutter 9151 and a second shutter 9152 are interlocked.

Referring to FIG. 38, a crank 9153 is provided between the first shutter 9151 and the second shutter 9152.

The crank 9153 includes a circular gear 91531, a crank shaft 91532 provided in the second shutter 9152 in a vertical direction, and a linear gear 91533 provided in the first shutter 9151 in a horizontal direction. The crank shaft 91532 may include a first end to be rotatably put on a crank pin 91534 provided on the outer circumference of the circular gear 91531. The linear gear 91533 may engage with the circular gear 91531.

When a knob 91541 moves leftward, the first shutter 9151 horizontally moves leftward. In this case, the linear gear 91533 makes the circular gear 91531 spin, and the spinning circular gear 91531 rotates the first end of the crank shaft 91532. In result, the second shutter 9152 is moved up or down to adjust the sizes of the first to fifth cold-air outlets 213-1~213-5.

The second shutter 8152 may move down as the crank 9153 operates in reverse order.

Although embodiments of the disclosure have been described in detail, various changes in the disclosure can be made without departing from the scope of the appended claims.

What is claimed is:

1. A refrigerator comprising:

a plurality of storage compartments;

an evaporator configured to generate cold air;

a duct including a plurality of channels to flow the cold air to the plurality of storage compartments; and a cold-air adjuster including:

a plurality of open or close members in the plurality of channels that are operable to adjust a volume of cold air flowing to the plurality of storage compartments, and including at least one open or close member that is operable to adjust a volume of cold air flowing to a first storage compartment of the plurality of storage compartments, and at least one other open or close member that is operable to adjust a volume of cold air flowing to a second storage compartment of the plurality of storage compartments, wherein the at least one open or close member is coupled to the at least one other open or close member, and an actuator coupled to the at least one open or close member, and configured to be positionable in:

a first range to operate the at least one open or close member without the at least one other open or close member being operated, to thereby adjust the volume of cold air flowing to the first storage compartment without adjusting the volume of cold air flowing to the second storage compartment, and a second range to operate the at least one open or close member and the at least one other open of close member, to thereby adjust the volume of cold air flowing to the first storage compartment and the volume of cold air flowing to the second storage compartment.

2. The refrigerator of claim 1, wherein the plurality of channels includes a connection channel to carry cold air to the first storage compartment, and a cold-air outlet to discharge cold air to the second storage compartment, the at least one open or close member is a first open or close member to adjust the volume of cold air passing through the connection channel; and the at least one other open or close member is a second open or close member to adjust a size of the cold-air outlet.

3. The refrigerator of claim 2, wherein the actuator includes a manipulator;

the first and second open or close member comprise is a first shutter, the second open or close member is a second shutter, and the manipulator includes:

a knob extending from the first shutter and configured to be manipulated by a user, and a guide slot in the second shutter to accommodate the knob to guide movement of the knob.

4. The refrigerator of claim 3, wherein the guide slot includes:

a horizontal slot to guide movement of the knob accommodated therein in a horizontal direction so that the first shutter can adjust the volume of cold air passing through the connection channel, and an inclined slot elongated in a vertically inclined direction communicating with the horizontal slot, and configured so that the second shutter moves vertically as the knob moves in a horizontal direction.

5. The refrigerator of claim 4, wherein the second shutter switches between a first mode and a second mode based on vertical movement, in which the first mode is configured to increase or decrease the size of the cold-air outlet and the second mode is configured to close or open the cold-air outlet.

6. The refrigerator of claim 1, wherein the plurality of channels includes a connection channel to carry cold air to the first storage compartment, and a cold-air outlet to discharge cold air to the second storage compartment, the at least one open or close member is a first open or close member to adjust the volume of cold air flowing in the connection channel, the at least one other open or close member is a second open or close member to increase or decrease the volume of cold air discharged to the cold-air outlet, and the refrigerator further comprises a third open or close member to close or open the cold-air outlet.

7. The refrigerator of claim 6, wherein the actuator includes a manipulator;

the first open or close member is a first shutter, the second open or close member is a second shutter, and the third open or close member is a third shutter, and the manipulator includes:

a knob extending from the first shutter and configured to be manipulated by a user, a first guide slot in the second shutter to guide movement of the knob accommodated therein, and a second guide slot in the third shutter to overlap with the first guide slot and guide movement of the knob accommodated therein.

8. The refrigerator of claim 7, wherein the first guide slot includes:

a first horizontal slot to guide the movement of the knob accommodated therein in a horizontal direction so that the first shutter adjusts the volume of cold air passing through the connection channel, a first inclined slot elongated in a vertically inclined direction to communicate with the first horizontal slot, so that the second shutter is moved in a vertical direction to adjust a size of the cold-air outlet as the knob moves in the horizontal direction, and a second horizontal slot to communicate with the first inclined slot and to guide movement of the knob in the horizontal direction, and the second guide slot includes:

a third horizontal slot to guide movement of the knob accommodated therein in the horizontal direction so that the first shutter is configured to adjust an amount of cold air passing through the connection channel, a second inclined slot elongated in the vertically inclined direction to communicate with the third horizontal slot, and to cause the third shutter to move in the vertical direction to adjust the size of the cold-air outlet as the knob moves in the horizontal direction, and a third inclined slot elongated in the vertically inclined direction to communicate with the second inclined slot, and to cause the third shutter to move in the vertical direction to close or open the cold-air outlet as the knob moves in the horizontal direction.

9. The refrigerator of claim 7, wherein the first guide slot includes:

a first horizontal slot to guide movement of the knob accommodated therein in a horizontal direction so that the first shutter is configured to adjust the volume of cold air passing through the connection channel, a first inclined slot elongated in a vertically inclined direction to communicate with the first horizontal slot, and to cause the second shutter to move in a vertical direction to adjust a size of the cold-air outlet as the knob moves in the horizontal direction, and a second horizontal slot to communicate with the first inclined slot and to guide movement of the knob in the horizontal direction, and the second guide slot includes:

a third horizontal slot to guide movement of the knob accommodated therein in the horizontal direction to adjust the volume of cold air passing through the connection channel, and a second inclined slot elongated in the vertically inclined direction to communicate with the third horizontal slot, to cause the third shutter to move in the vertical direction to adjust the size of the cold-air outlet as the knob moves in the horizontal direction, and overlapping a same length with the first inclined slot.

10. The refrigerator of claim 9, wherein the second shutter is configured to move vertically to adjust the size of the cold-air outlet as the knob moves horizontally while accommodated in the first inclined slot, and the third shutter is configured to move horizontally to close or open the cold-air outlet as the knob moves horizontally while accommodated in a lower end portion of the second inclined slot.

11. The refrigerator of claim 10, wherein the manipulator includes at least one of an X-link or a rack and a pinion or a crank to move the second shutter up or down based on manipulation of the first shutter.

12. A refrigerator comprising:

a main body including a first storage compartment and a second storage compartment separate from the first storage compartment;

a duct including:

a channel to carry cold air, a plurality of cold-air exits to discharge cold air to the first storage compartment, and a connection channel to carry cold air to the second storage compartment; and a cold-air adjuster including:

a plurality of open or close members to adjust a volume of cold air discharged to the first storage compartment and the second storage compartment, and an actuator configured to cause the plurality of open or close members to move, the actuator being configured to be movable between:

a first position to adjust the volume of cold air discharged to the first storage compartment, and a second position to adjust the volume of cold air discharged to the second storage compartment without the volume of cold air discharged to the second storage compartment being adjusted.

13. The refrigerator of claim 12, wherein the plurality of open or close members includes:

first and second open or close members to adjust the volume of cold air supplied to the first storage compartment, and a third open or close member to adjust the volume of cold air supplied to the second storage compartment, and at least one of the plurality of open or close members is configured to move based on movement of the actuator.

14. The refrigerator of claim 13, wherein the third open or close member includes a cold-air through hole having a size that is varied based on the actuator being in the second position to adjust the volume of cold air passing through the connection channel.

15. The refrigerator of claim 12, wherein a size of at least one of the cold-air exits is varied based on the first or second open or close member being moved based on a position of the actuator.

16. A refrigerator comprising:

a main body having a refrigerator compartment and a freezer compartment;

an evaporator configured to provide cold air;

a first channel to carry the cold air to the refrigerator compartment;

a second channel to carry the cold air to the freezer compartment; and a cold air adjuster including:

a first damper configured to adjust a volume of cold air flowing to the refrigerator compartment, a second damper configured to adjust a volume of cold air flowing to the freezer compartment, and an actuator configured to:

operate, based on a position of the actuator, the first damper, while the freezer compartment is supplied with cold air sufficient to produce freezing, to adjust the volume of cold air flowing to the refrigerator compartment without adjusting the volume of cold air flowing to the freezer compartment, and operate, based on the position of the actuator, the first and second dampers to adjust the volume of cold air flowing to the refrigerator compartment and the volume of cold air flowing to the freezer compartment to produce refrigeration in the freezer compartment or to stop the flow of cold air to the freezer compartment.

17. The refrigerator of claim 16, wherein the actuator extends from the first damper to control operation of the first damper, and the first damper is coupled to the second damper such that, based on the position of the actuator, movement of the second damper is caused by movement of the first damper.

* * * * *